US011538405B2

(12) United States Patent
Yuan et al.

(10) Patent No.: US 11,538,405 B2
(45) Date of Patent: Dec. 27, 2022

(54) PIXEL DRIVING CIRCUIT, PIXEL DRIVING METHOD, DISPLAY PANEL AND DISPLAY DEVICE

(71) Applicant: BOE TECHNOLOGY GROUP CO., LTD., Beijing (CN)

(72) Inventors: Lijun Yuan, Beijing (CN); Can Zhang, Beijing (CN); Ning Cong, Beijing (CN); Wei Li, Beijing (CN); Can Wang, Beijing (CN); Jinfei Niu, Beijing (CN); Jingjing Zhang, Beijing (CN); Minghua Xuan, Beijing (CN)

(73) Assignee: Beijing BOE Technology Development Co., Ltd., Beijing (CN)

( * ) Notice: Subject to any disclaimer, the term of this patent is extended or adjusted under 35 U.S.C. 154(b) by 0 days.

(21) Appl. No.: 17/531,274

(22) Filed: Nov. 19, 2021

(65) Prior Publication Data

US 2022/0301492 A1 Sep. 22, 2022

(30) Foreign Application Priority Data

Mar. 19, 2021 (CN) ..... 202110298413.2

(51) Int. Cl.
*G09G 3/32* (2016.01)

(52) U.S. Cl.
CPC ..... *G09G 3/32* (2013.01); *G09G 2300/0426* (2013.01); *G09G 2300/0819* (2013.01); *G09G 2300/0852* (2013.01); *G09G 2300/0861* (2013.01)

(58) Field of Classification Search
CPC ..... G09G 3/32; G09G 2300/0426; G09G 2300/0819; G09G 2300/0852; G09G 2300/0861
See application file for complete search history.

(56) References Cited

U.S. PATENT DOCUMENTS

2005/0168417 A1 8/2005 Ha et al.
2019/0347987 A1* 11/2019 Zhao ..... G09G 3/3233

FOREIGN PATENT DOCUMENTS

CN 1658264 A 8/2005
CN 101751860 A 6/2010
CN 108538241 A 9/2018
(Continued)

OTHER PUBLICATIONS

Office Action dated Nov. 29, 2021 issued in corresponding Chinese Application No. 202110298413.2.

*Primary Examiner* — Alexander Eisen
*Assistant Examiner* — Nathaniel P Brittingham
(74) *Attorney, Agent, or Firm* — Nath, Goldberg & Meyer; Joshua B. Goldberg

(57) ABSTRACT

The pixel driving circuit includes a current control circuit and a gating circuit. The current control circuit is configured to transmit a driving current signal to an element to be driven. The gating circuit is configured to transmit a second voltage signal from a second voltage signal terminal to the element to be driven such that the element to be driven continuously emits light or transmit a third voltage signal from a third voltage signal terminal to the element to be driven such that the element to be driven intermittently emits light, under the control of a scan signal from a scan signal terminal, a reset signal from a reset signal terminal and a second data signal from a second data signal terminal.

19 Claims, 11 Drawing Sheets

(56) References Cited

FOREIGN PATENT DOCUMENTS

| | | | |
|---|---|---|---|
| CN | 109686318 | A | 4/2019 |
| CN | 109872680 | A | 6/2019 |
| CN | 110021264 | A | 7/2019 |
| CN | 111210765 | A | 5/2020 |
| JP | 2001306031 | A | 11/2001 |

* cited by examiner

PIXEL DRIVING CIRCUIT, PIXEL DRIVING METHOD, DISPLAY PANEL AND DISPLAY DEVICE

CROSS REFERENCE TO RELATED APPLICATIONS

The present application claims the priority of the Chinese Patent Application No. 202110298413.2 entitled "pixel driving circuit, pixel driving method, display panel and display device" filed on Mar. 19, 2021, the content of which is incorporated herein by reference in its entirety.

TECHNICAL FIELD

The present disclosure relates to the field of display technology, and in particular, to a pixel driving circuit, a pixel driving method, a display panel, and a display device.

BACKGROUND

A micro light emitting diode has the characteristics of high light emitting efficiency at high current density, low light emitting efficiency and main wave peak shifting at low current density. The concrete performance is as follows: when the driving current input into the micro light emitting diode reaches a certain value, the light emitting efficiency of the micro light emitting diode reaches its highest; when the driving current does not reach the value, the light emitting efficiency of the micro light emitting diode is always in a climbing phase, that is, the light emitting intensity of the micro light emitting diode gradually increases with the increase of the supplied driving current, and meanwhile, the light emitting efficiency gradually increases. That is, the micro light emitting diode has low light emitting efficiency at low current density.

Therefore, it is an urgent problem to be solved in the pixel driving circuit of the micro light emitting diode to drive the micro light emitting diode to display a low gray scale.

SUMMARY

The embodiment of the present disclosure provides a pixel driving circuit, a pixel driving method, a display panel and a display device, which may enable a micro light emitting diode to realize full gray scale display.

In order to achieve the above purpose, the embodiments of the present disclosure adopt the following technical solutions:

In one aspect, the embodiments of the present disclosure provide a pixel driving circuit. The pixel driving circuit includes a current control circuit and a gating circuit. The current control circuit is coupled to a scan signal terminal, a first data signal terminal, a first voltage signal terminal, an enable signal terminal, and an element to be driven. The current control circuit is configured to transmit a driving current signal to the element to be driven according to a first data signal from the first data signal terminal under the control of a scan signal from the scan signal terminal and an enable signal from the enable signal terminal. The gating circuit is coupled to the scan signal terminal, a reset signal terminal, a second data signal terminal, a second voltage signal terminal and a third voltage signal terminal. The gating circuit is configured to transmit a second voltage signal from the second voltage signal terminal to the element to be driven such that the element to be driven continuously emits light; or transmit a third voltage signal from the third voltage signal terminal to the element to be driven such that the element to be driven intermittently emits light, under the control of a scan signal from the scan signal terminal, a reset signal from the reset signal terminal and a second data signal from the second data signal terminal.

In some embodiments, the gating circuit includes a first gating sub-circuit and a second gating sub-circuit. The first gating sub-circuit is coupled to the scan signal terminal, the second data signal terminal and the second voltage signal terminal, the first gating sub-circuit is configured to transmit the second voltage signal from the second voltage terminal to the element to be driven under the control of the scan signal from the scan signal terminal and the second data signal from the second data signal terminal, such that the element to be driven continuously emits light. The second gating sub-circuit is coupled to the reset signal terminal, the second data signal terminal and the third voltage signal terminal; the second gating sub-circuit is configured to transmit the third voltage signal from the third voltage terminal to the element to be driven under the control of the reset signal from the reset signal terminal and the second data signal from the second data signal terminal, such that the element to be driven intermittently emits light.

In some embodiments, the first gating sub-circuit includes a first data writing unit and a first control unit. The first data writing unit is coupled to the scan signal terminal, the second data signal terminal and a first node; the first data writing unit is configured to transmit the second data signal from the second data signal terminal to the first node under the control of the scan signal from the scan signal terminal. The first control unit is coupled to the first node and the second voltage signal terminal; the first control unit is configured to transmit the second voltage signal from the second voltage terminal to the element to be driven under the control of a voltage at the first node.

In some embodiments, the first gating sub-circuit further includes a first energy storage unit which is coupled to an initialization signal terminal and the first node, and is configured to store and maintain the voltage at the first node.

In some embodiments, the first data writing unit includes a first transistor, a control electrode of the first transistor is coupled to the scan signal terminal, a first electrode of the first transistor is coupled to the second data signal terminal, a second electrode of the first transistor is coupled to the first node; the first energy storage unit includes a first capacitor, a first terminal of the first capacitor is coupled to the initialization signal terminal, and a second terminal of the first capacitor is coupled to the first node. The first control unit includes a second transistor, a control electrode of the second transistor is coupled to the first node, a first electrode of the second transistor is coupled to the second voltage signal terminal, and a second electrode of the second transistor is coupled to the element to be driven or the current control sub-circuit.

In some embodiments, the second gating sub-circuit includes a second data writing unit and a second control unit. Wherein, the second data writing unit is coupled to the reset signal terminal, the second data signal terminal and a second node; the second data writing unit is configured to transmit the second data signal from the second data signal terminal to the second node under the control of the reset signal from the reset signal terminal. The second control unit is coupled to the second node and the third voltage signal terminal; the second control unit is configured to transmit the third voltage signal from the third voltage terminal to the element to be driven under the control of a voltage at the second node.

In some embodiments, the second gating sub-circuit further includes a second energy storage unit coupled to an initialization signal terminal and the second node, and the second energy storage unit is configured to store and maintain the voltage at the second node.

In some embodiments, the second data writing unit includes a third transistor, a control electrode of the third transistor is coupled to the reset signal terminal, a first electrode of the third transistor is coupled to the second data signal terminal, and a second electrode of the third transistor is coupled to the second node. The second energy storage unit includes a second capacitor, a first terminal of the second capacitor is coupled to the initialization signal terminal, and a second terminal of the second capacitor is coupled to the second node. The second control sub-circuit includes a fourth transistor, a control electrode of the fourth transistor is coupled to the second node, a first electrode of the fourth transistor is coupled to the third voltage signal terminal, and a second electrode of the fourth transistor is coupled to the element to be driven or the current control sub-circuit.

In some embodiments, the second voltage signal terminal is a signal terminal for transmitting a direct current voltage signal; the third voltage signal terminal is a signal terminal for transmitting a pulse voltage signal.

In some embodiments, the current control circuit is coupled to a first electrode of the element to be driven, the gating circuit is coupled to a second electrode of the element to be driven, and a voltage signal transmitted by the second voltage signal terminal is different from a voltage signal transmitted by the first voltage signal terminal. Or, the current control circuit is coupled to a first electrode of the element to be driven, a second electrode of the element to be driven is coupled to a direct current voltage signal terminal, the gating circuit is coupled to the current control circuit, and a voltage signal transmitted by the second voltage signal terminal is the same as a voltage signal transmitted by the first voltage signal terminal.

In some embodiments, the current control circuit includes: a data writing sub-circuit, a driving sub-circuit, a compensation sub-circuit, an energy storage sub-circuit, a control sub-circuit, and a reset sub-circuit. Wherein, the data writing sub-circuit is coupled to the scan signal terminal, the first data signal terminal and a third node; the data writing sub-circuit is configured to transmit the first data signal from the first data signal terminal to the third node under the control of the scan signal from the scan signal terminal. The driving sub-circuit is coupled to the third node, a fourth node and a fifth node; the driving sub-circuit is configured to be turned on under the control of a voltage at the fifth node. The compensation sub-circuit is coupled to the scan signal terminal, the fourth node and the fifth node; the compensation sub-circuit is configured to compensate the voltage at the fifth node under the control of the scan signal from the scan signal terminal, so that the voltage at the fifth node is related to a threshold voltage of the driving sub-circuit. The energy storage sub-circuit is coupled to the fifth node and the first voltage signal terminal; the energy storage sub-circuit is configured to store and maintain the voltage at the fifth node. The control sub-circuit is coupled to the enable signal terminal, the third node, the fourth node and the element to be driven, and is further coupled to the first voltage signal terminal or the gating circuit; the control sub-circuit is configured to transmit a driving current signal to the element to be driven in cooperation with the third driving sub-circuit under the control of the enable signal from the enable signal terminal. The reset sub-circuit is coupled to the reset signal terminal, an initialization signal terminal, and the fifth node; the reset sub-circuit is configured to transmit the initialization voltage signal from the initialization signal terminal to the fifth node under the control of the reset signal from the reset signal terminal.

In some embodiments, the data writing sub-circuit includes a fifth transistor, a control electrode of the fifth transistor is coupled to the scan signal terminal, a first electrode of the fifth transistor is coupled to the first data signal terminal, and a second electrode of the fifth transistor is coupled to the third node. The driving sub-circuit includes a sixth transistor, a control electrode of the sixth transistor is coupled to the fifth node, a first electrode of the sixth transistor is coupled to the third node, and a second electrode of the sixth transistor is coupled to the fourth node. The compensation sub-circuit includes a seventh transistor, a control electrode of the seventh transistor is coupled to the scan signal terminal, a first electrode of the seventh transistor is coupled to the fourth node, and a second electrode of the seventh transistor is coupled to the fifth node. The energy storage sub-circuit includes a third capacitor, a first terminal of the third capacitor is coupled to the first voltage signal terminal and a second terminal of the third capacitor is coupled to the fifth node. The control sub-circuit includes an eighth transistor and a ninth transistor, wherein the control electrode of the eighth transistor is coupled to the enable signal terminal, the first electrode of the eighth transistor is coupled to the first voltage signal terminal or the gating circuit, and the second electrode of the eighth transistor is coupled to the third node; a control electrode of the ninth transistor is coupled to the enable signal terminal, a first electrode of the ninth transistor is coupled to the fourth node, and a second electrode of the ninth transistor is coupled to the element to be driven. The reset sub-circuit includes a tenth transistor, a control electrode of the tenth transistor is coupled to the reset signal terminal, a first electrode of the tenth transistor is coupled to the initialization signal terminal, and a second electrode of the tenth transistor is coupled to the fifth node.

In some embodiments, the current control circuit includes; a fifth transistor, a sixth transistor, a seventh transistor, an eighth transistor, a ninth transistor, a tenth transistor, and a third capacitor. A control electrode of the fifth transistor is coupled to the scan signal terminal, a first electrode of the fifth transistor is coupled to the first data signal terminal, and a second electrode of the fifth transistor is coupled to the third node. A control electrode of the sixth transistor is coupled to the fifth node, a first electrode of the sixth transistor is coupled to the third node, and a second electrode of the sixth transistor is coupled to the fourth node. A control electrode of the seventh transistor is coupled to the scan signal terminal, a first electrode of the seventh transistor is coupled to the fourth node, and a second electrode of the seventh transistor is coupled to the fifth node. A control electrode of the eighth transistor is coupled to the enable signal terminal, a first electrode of the eighth transistor is coupled to the first voltage signal terminal, and a second electrode of the eighth transistor is coupled to the third node. A control electrode of the ninth transistor is coupled to the enable signal terminal, a first electrode of the ninth transistor is coupled to the fourth node, and a second electrode of the ninth transistor is coupled to the first electrode of the element to be driven. A control electrode of the tenth transistor is coupled to the reset signal terminal, a first electrode of the tenth transistor is coupled to the initialization signal terminal, and a second electrode of the tenth transistor is coupled to the fifth node. A first terminal of the third capacitor is coupled to the first voltage signal terminal, and a second terminal of the third capacitor is coupled to the fifth node.

The gating circuit includes: a first transistor, a second transistor, a third transistor, a fourth transistor, a first capacitor, and a second capacitor. A control electrode of the first transistor is coupled to the scan signal terminal, a first electrode of the first transistor is coupled to the second data signal terminal, and a second electrode of the first transistor is coupled to the first node. A control electrode of the second transistor is coupled to the first node, a first electrode of the second transistor is coupled to the second voltage signal terminal, and a second electrode of the second transistor is coupled to the second electrode of the element to be driven. A control electrode of the third transistor is coupled to the reset signal terminal, a first electrode of the third transistor is coupled to the second data signal terminal, and a second electrode of the third transistor is coupled to the second node. A control electrode of the fourth transistor is coupled to the second node, a first electrode of the fourth transistor is coupled to the third voltage signal terminal, and a second electrode of the fourth transistor is coupled to the second electrode of the element to be driven. A first terminal of the first capacitor is coupled to the initialization signal terminal, and a second terminal of the first capacitor is coupled to the first node. A first terminal of the second capacitor is coupled to the initialization signal terminal, and a second terminal of the second capacitor is coupled to the second node.

In some embodiments, the current control circuit includes: a fifth transistor, a sixth transistor, a seventh transistor, an eighth transistor, a ninth transistor, a tenth transistor, and a third capacitor. A control electrode of the fifth transistor is coupled to the scan signal terminal, a first electrode of the fifth transistor is coupled to the first data signal terminal, and a second electrode of the fifth transistor is coupled to the third node. A control electrode of the sixth transistor is coupled to the fifth node, a first electrode of the sixth transistor is coupled to the third node, and a second electrode of the sixth transistor is coupled to the fourth node. A control electrode of the seventh transistor is coupled to the scan signal terminal, a first electrode of the seventh transistor is coupled to the fourth node, and a second electrode of the seventh transistor is coupled to the fifth node. A control electrode of the eighth transistor is coupled to the enable signal terminal, a first electrode of the eighth transistor is coupled to the gating circuit, and a second electrode of the eighth transistor is coupled to the third node. A control electrode of the ninth transistor is coupled to the enable signal terminal, a first electrode of the ninth transistor is coupled to the fourth node, and a second electrode of the ninth transistor is coupled to the first electrode of the element to be driven. A control electrode of the tenth transistor is coupled to the reset signal terminal, a first electrode of the tenth transistor is coupled to the initialization signal terminal, and a second electrode of the tenth transistor is coupled to the fifth node. A first terminal of the third capacitor is coupled to the first voltage signal terminal, and a second terminal of the third capacitor is coupled to the fifth node.

The gating circuit includes: a first transistor, a second transistor, a third transistor, a fourth transistor, a first capacitor, and a second capacitor. A control electrode of the first transistor is coupled to the scan signal terminal, a first electrode of the first transistor is coupled to the second data signal terminal, and a second electrode of the first transistor is coupled to the first node. A control electrode of the second transistor is coupled to the first node, a first electrode of the second transistor is coupled to the second voltage signal terminal, and a second electrode of the second transistor is coupled to the first electrode of the eighth transistor. A control electrode of the third transistor is coupled to the reset signal terminal, a first electrode of the third transistor is coupled to the second data signal terminal, and a second electrode of the third transistor is coupled to the second node. A control electrode of the fourth transistor is coupled to the second node, a first electrode of the fourth transistor is coupled to the third voltage signal terminal, and a second electrode of the fourth transistor is coupled to the first electrode of the eighth transistor. A first terminal of the first capacitor is coupled to the initialization signal terminal, and a second terminal of the first capacitor is coupled to the first node. A first terminal of the second capacitor is coupled to the initialization signal terminal, and a second terminal of the second capacitor is coupled to the second node.

In the pixel driving circuit provided by the embodiments of the present disclosure, the second voltage signal or the third voltage signal may be input to the element to be driven under the control of the gating circuit; and in the case where the gating circuit inputs the second voltage signal to the element to be driven, the element to be driven continuously emits light; in the case where the gating circuit inputs the third voltage signal to the element to be driven, the element to be driven intermittently emits light. Therefore, when the display luminance of the element to be driven is required to be a high gray scale, the second voltage signal may be input to the element to be driven by the gating circuit, so that the element to be driven may continuously emit light in one frame; and the magnitude of the current flowing through the element to be driven is controlled, so as to control the element to be driven to display different high gray scales. When the display luminance of the element to be driven is required to be a low gray scale, the third voltage signal may be input to the element to be driven by the gating circuit, so that the element to be driven intermittently emits light in one frame, and thus, the light emitting duration of the element to be driven in one frame is shortened; further, without reducing the light emitting intensity of the element to be driven (without reducing the current flowing through the element to be driven when the element to be driven emits light), the luminance (gray scale) perceived by human eyes is reduced, so that the element to be driven displays a low gray scale at a higher current. Thus, the current magnitude of the element to be driven when displaying the low gray scale may be increased, so that the current transmitted to the element to be driven is larger, and the element to be driven may display a high gray scale and a low gray scale at high current density, thereby enabling the element to be driven to realize full gray scale display.

On the other hand, an embodiment of the present disclosure further provides a pixel driving method, which is applied to the pixel driving circuit in any one of the above embodiments, wherein the gating circuit of the pixel driving circuit includes a first gating sub-circuit and a second gating sub-circuit; one frame period includes a reset phase, a scan phase, and a light emitting phase. The pixel driving method includes:

in the case where the display luminance is required to be a high gray scale; during the reset phase, the second gating sub-circuit writes a turn-off voltage of the second data signal from the second data signal terminal under the control of the reset signal from the reset signal terminal; during the scan phase, the first gating sub-circuit writes a turn-on voltage of a second data signal from the second data signal terminal under the control of the scan signal from the scan signal terminal; during the light emitting phase, the first gating sub-circuit transmits the second voltage signal from the second voltage signal terminal to the element to be driven, and drives the element to be driven to continuously emit light in cooperation with the current control circuit of the pixel driving circuit, under the control of the turn-on voltage of the second data signal;

in the case where the display luminance is required to be low gray; during the reset phase, the second gating sub-circuit writes a turn-on voltage of the second data signal from the second data signal terminal under the control of the reset signal from the reset signal terminal; during the scan phase, the first gating sub-circuit writes the turn-off voltage of a second data signal from the second data signal terminal under the control of the scan signal from the scan signal terminal; during the light emitting phase, the second gating sub-circuit transmits the third voltage signal from the third voltage signal terminal to the element to be driven, and drives the element to be driven to intermittently emit light in cooperation with the current control circuit, under the control of the turn-on voltage of the second data signal.

According to the pixel driving method provided by the embodiment of the present disclosure, the element to be driven may display a high gray scale and a low gray scale at high current density, thereby enabling the element to be driven to realize full gray scale display.

In another aspect, an embodiment of the present disclosure further provides a display panel, which includes an element to be driven and the pixel driving circuit described in any one of the above embodiments; the element to be driven is coupled to the pixel driving circuit.

The display panel provided by the embodiment of the present disclosure includes the above mentioned pixel driving circuit, and the element to be driven contained in the display panel may display a high gray scale and a low gray scale at high current density, thereby enabling the element to be driven to realize full gray scale display.

In another aspect, an embodiment of the present disclosure further provides a display device including the display panel.

The display device provided by the embodiment of the present disclosure includes the above mentioned display panel, and the element to be driven contained in the display panel may display a high gray scale and a low gray scale at high current density, thereby enabling the element to be driven to realize full gray scale display.

BRIEF DESCRIPTION OF DRAWINGS

In order to more clearly illustrate the technical solutions of the present disclosure, the drawings required in some embodiments of the present disclosure will be briefly described below. It is apparent that the drawings in the following description are only drawings of some embodiments of the present disclosure, and other drawings may be obtained by one of ordinary skill in the art based on these drawings. Furthermore, the drawings in the following description may be considered as schematic diagrams, and do not limit an actual size of products, an actual flow of methods, an actual timing of signals, and the like involved in the embodiments of the present disclosure.

DETAIL DESCRIPTION OF EMBODIMENTS

Figure 1:
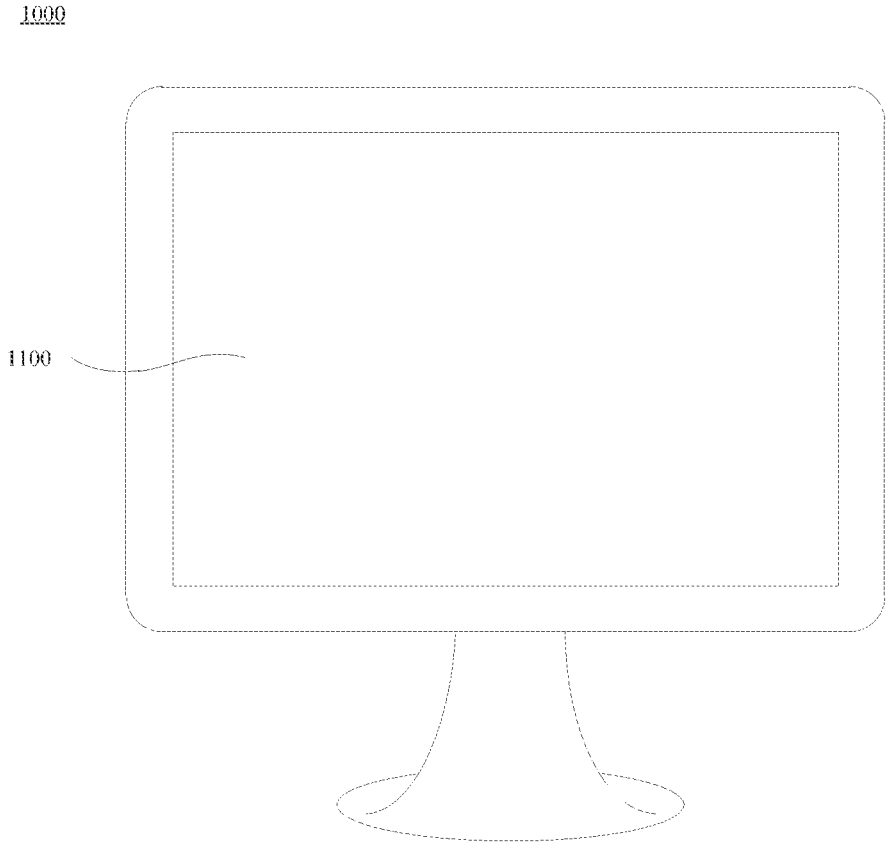
FIG. 1 is a structural diagram of a display device according to an embodiment of the present disclosure.

The technical solutions in some embodiments of the present disclosure will be clearly and completely described below with reference to the accompanying drawings. It is to be understood that the described embodiments are only a part of the embodiments of the present disclosure, and not all of the embodiments. All other embodiments, which are obtained by one of ordinary skill in the art based on the embodiments provided in the present disclosure, are within the scope of protection of the present disclosure.

Unless the context requires otherwise, throughout the specification and the claims, the term "comprise" will be interpreted as an open, inclusive meaning, i.e., as "including, but not limited to". In the description of the specification, the terms "some embodiments", "example" or "some examples" and the like are intended to indicate that a particular feature, structure, or characteristic in connection with the embodiment or example is included in at least one embodiment or example of the present disclosure. The schematic representations of the above terms do not necessarily refer to a same embodiment or example. Furthermore, the particular feature, structure, or characteristic may be included in any of one or more embodiments or examples in any suitable manner.

In the following, the terms "first", "second" and the like are used for descriptive purposes only and are not to be understood as indicating or implying relative importance or implicitly indicating the number of technical features indicated. Thus, a feature defined by "first" or "second" may explicitly or implicitly include one or more features. In the description of the embodiments of the present disclosure, "a plurality" means two or more unless otherwise specified.

Transistors used in a pixel driving circuit provided in the embodiments of the present disclosure may be Thin Film Transistors (TFTs), field effect transistors (metal oxide semiconductor, MOS), or other switching devices with the same characteristics. Thin film transistors are described as an example in the embodiments of the present disclosure.

A control electrode of each thin film transistor adopted by the pixel driving circuit is a gate electrode of the thin film transistor, a first electrode is one of a source electrode and a drain electrode of the thin film transistor, and a second electrode is the other of the source electrode and the drain electrode of the thin film transistor. Since the source and drain electrodes of the thin film transistor may be symmetrical in structure, the source and drain electrodes may have no difference in structure. That is, the first and second electrodes of the thin film transistor in the embodiment of the present disclosure may have no difference in structure. For example, in the case where the thin film transistor is a P-type transistor, the first electrode of the thin film transistor is a source electrode, and the second electrode is a drain electrode; for example, in the case where the thin film transistor is an N-type transistor, the first electrode of the thin film transistor is a drain electrode and the second electrode is a source electrode.

In addition, in the pixel driving circuits provided in embodiments of the present disclosure, as an example, the thin film transistor is described as a P-type transistor. It should be noted that the embodiments of the present disclosure include, but are not limited to, the above example. For example, one or more thin film transistors in the pixel driving circuit provided by the embodiment of the present disclosure may alternatively be one or more N-type transistors, and it is only necessary to couple electrodes of the selected type of thin film transistors correspondingly with reference to electrodes of the corresponding thin film transistors in the embodiment of the present disclosure, and enable each of the corresponding voltage terminals to provide a corresponding high level voltage or low level voltage.

In the pixel driving circuit provided by the embodiment of the present disclosure, a capacitor may be a capacitor device separately manufactured by a process. For example, the capacitor device is realized by manufacturing specialized capacitor electrodes, and each capacitor electrode of the capacitor may be realized by a metal layer, a semiconductor layer (for example, doped poly-silicon), and the like. The capacitor may alternatively be a parasitic capacitor between the transistors, or realized by the transistors themselves and other devices and lines, or realized by using the parasitic capacitor between lines of the circuit itself.

In the pixel driving circuit provided by the embodiment of the present disclosure, a first node, a second node, and the like do not represent actually existing components, but represent junctions of relevant electrical connections in the circuit diagram, that is, the nodes are equivalent to the junctions of relevant electrical connections in the circuit diagram.

With the progress of display technology, the technology of semiconductor devices, which are the core of display devices, has been greatly advanced. As a current type light emitting device, Light Emitting Diodes (LEDs) are increasingly used in high performance display devices due to their characteristics of self-luminescence, fast response, and wide viewing angle.

The Micro Light Emitting Diode (Micro LED) display device has high luminance and wide color gamut, may meet the requirements of High-Dynamic Range (HDR) image technology on the luminance and the color gamut of the display device, and is more suitable for realizing HDR display.

Some embodiments of the present disclosure provide a display device 1000, and referring to FIG. 1, the display device 1000 may be a television, a computer, a notebook computer, a mobile phone, a tablet computer, a Personal Digital Assistant (PDA), a vehicle-mounted computer, or the like. The display device 1000 includes a frame, a display panel 1100 disposed in the frame, a circuit board, a display driver integrated circuit IC), and other electronic components.

Figure 2:
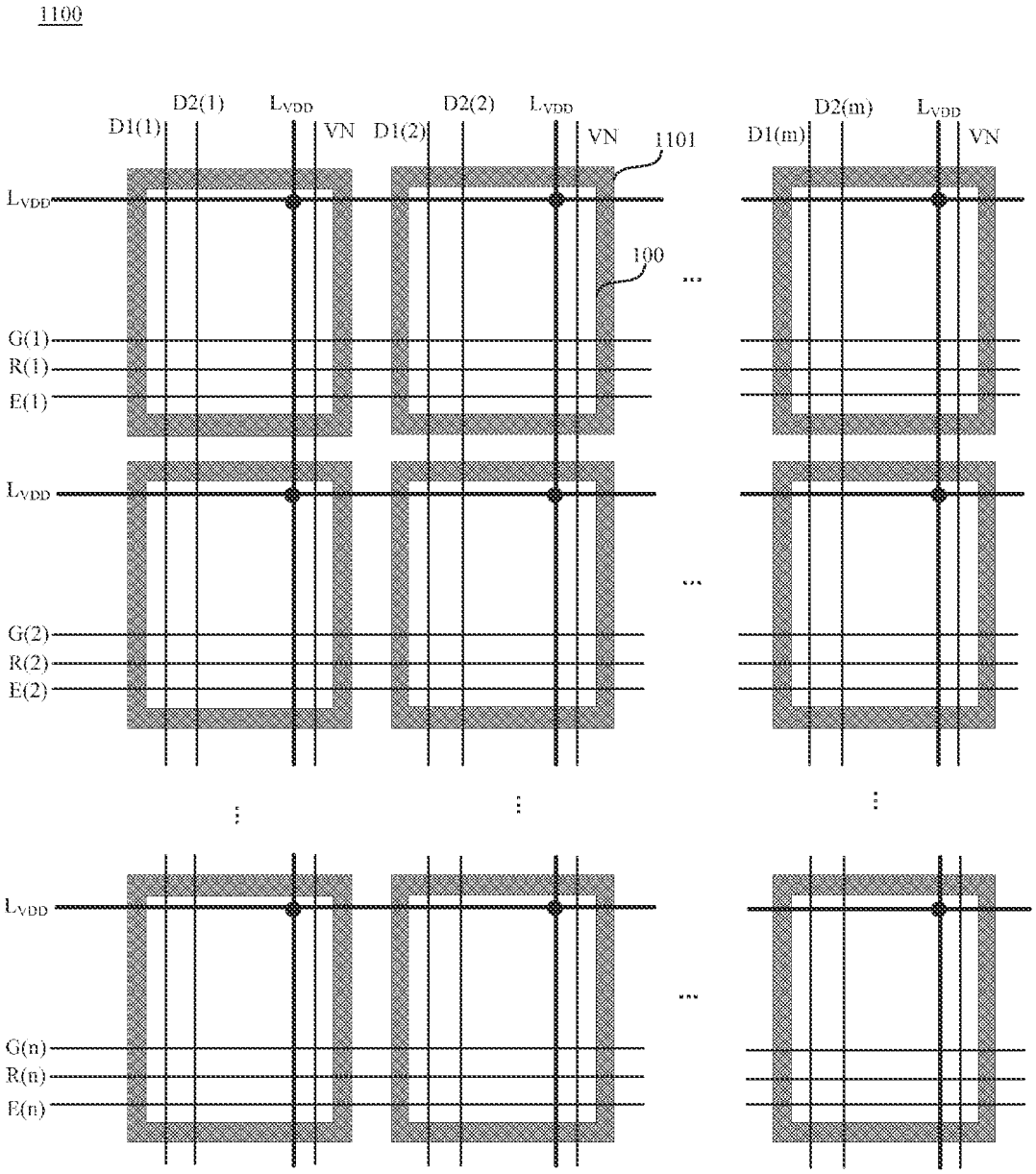
FIG. 2 is a structural diagram of a display panel according to an embodiment of the present disclosure.

Referring to FIG. 2, the display panel 1100 includes a plurality of sub-pixels 1101, each sub-pixel 1101 corresponds to one pixel driving circuit 100 and one element to be driven 200 (see FIGS. 3A and 3B), the plurality of sub-pixels 1101 are arranged in an array of a plurality of rows and a plurality of columns. For example, the plurality of sub-pixels 101 are arranged in an array of n rows and m columns.

In some embodiments, the element to be driven 200 includes at least one light emitting diode connected in series in a current path of the pixel driving circuit 100. The light emitting diode is a micro light emitting diode (micro LED), a mini LED or other light emitting device having characteristics of high light emitting efficiency at high current density and low light emitting efficiency at low current density, such as an organic light emitting diode, a quantum dot light emitting diode, which is not limited by the embodiments of the present disclosure. In the description of the embodiments of the present disclosure, a first electrode of the element to be driven 200 is an anode of the element to be driven 200, and a second electrode of the element to be driven 200 is a cathode of the element to be driven 200.

The display panel 1100 further includes: a plurality of scan signal lines G(1)-G(n), a plurality of first data signal lines D1(1)-D1(*m*), and a plurality of second data signal lines D2(1)-D2(*m*).

The pixel driving circuits 100 of a same row of sub-pixels 1101 are coupled to a same scan signal line G. The pixel driving circuits 100 of a same column of sub-pixels 1101 are coupled to a same first data signal line D1 and a same second data signal line D2. For example, the pixel driving circuits 100 corresponding to a first row of sub-pixels 1101 are coupled to a scan signal line G(1), and the pixel driving circuits 100 corresponding to a first column of sub-pixels 1101 are coupled to a first data signal line D1(1) and a second data signal line D2(1).

Thus, the plurality of scan signal lines G provide scan signals Gate1 for a scan signal terminal GATE; the plurality of first data signal lines D1 provide first data signals Data1 for a first data signal terminal DATA1; the plurality of second data signal lines D2 provide second data signals Data2 for a second data signal terminal DATA2.

The display panel 1100 further includes: a plurality of reset signal lines R(1) to R(n), a plurality of enable signal lines E(1) to E(n), and a plurality of initialization signal lines VN.

The pixel driving circuits 100 corresponding to a same row of sub-pixels 1101 are coupled to a same reset signal line R and a same enable signal line E. The pixel driving circuits 100 corresponding to a same column of sub-pixels 1101 are coupled to a same initialization signal line VN.

Thus, the plurality of reset signal lines R provide a reset signal Reset to a reset signal terminal RESET, the plurality of enable signal lines E provide an enable signal Em to an enable signal terminal EM, and the plurality of initialization signal lines VN provide an initialization signal Vinit to an initialization signal terminal VINIT.

The display panel 1100 further includes: a plurality of first voltage signal lines $L_{VDD}$, a plurality of second voltage signal lines LVSS (not shown in drawing), and a plurality of third voltage signal lines LVHf (not shown in drawing).

The plurality of first voltage signal lines $L_{VDD}$ are respectively arranged in a grid along a row direction and a column direction, and pixel driving circuits 100 corresponding to a same column of sub-pixels 1101 are coupled to a same first voltage signal line $L_{VDD}$ arranged along the column direction. The plurality of first voltage signal lines $L_{VDD}$ arranged in the row direction are respectively coupled to the plurality of first voltage signal lines $L_{VDD}$ arranged in the column direction, and are configured to reduce a resistance of the plurality of first voltage signal lines $L_{VDD}$ arranged in the column direction, and reduce an RC load and an IR Drop of a first voltage signal Vdd. The wiring manner of the plurality of second voltage signal lines LVSS and the plurality of third voltage signal lines LVHf is similar to that of the plurality of first voltage signal lines $L_{VDD}$, and is not repeated here.

Thus, the plurality of first voltage signal lines arranged in the column direction provide the first voltage signal Vdd for a first voltage signal terminal VDD; the plurality of second voltage signal lines LVSS provide voltage signals Vss for the pixel driving circuits 100, the plurality of third voltage signal lines LVHf provide third voltage signals Vhf to the pixel driving circuits 100.

It should be noted that the arrangement of the plurality of signal lines included in the display panel 1100 described above and the wiring diagram of the display panel 1100 shown in FIG. 2 are merely examples, and do not constitute a limit to the structure of the display panel 1100.

Figure 3A:
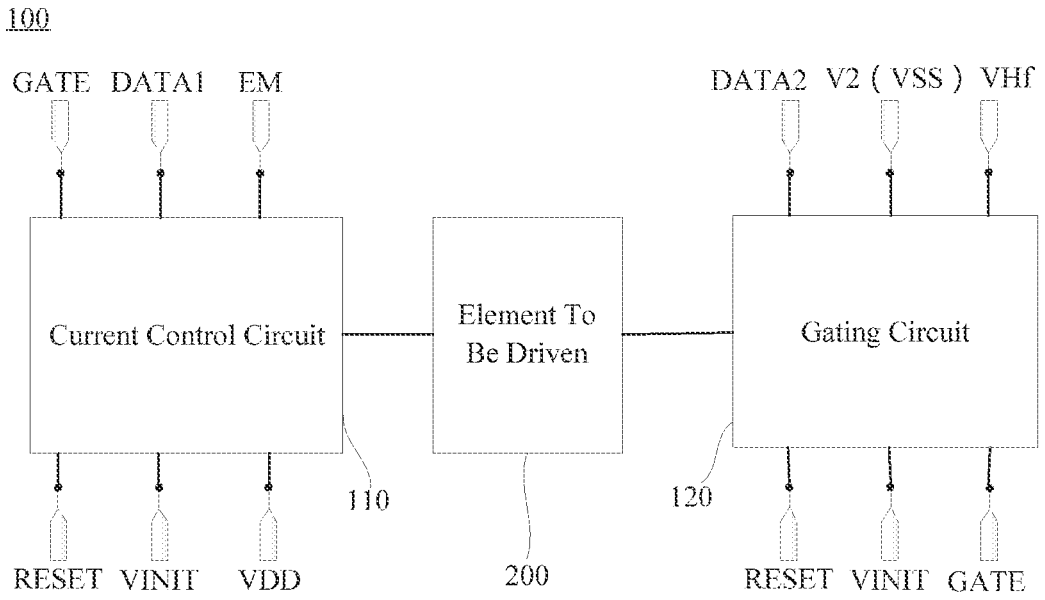
FIG. 3A is a block diagram of a structure of a pixel driving circuit according to an embodiment of the present disclosure.
Figure 3B:
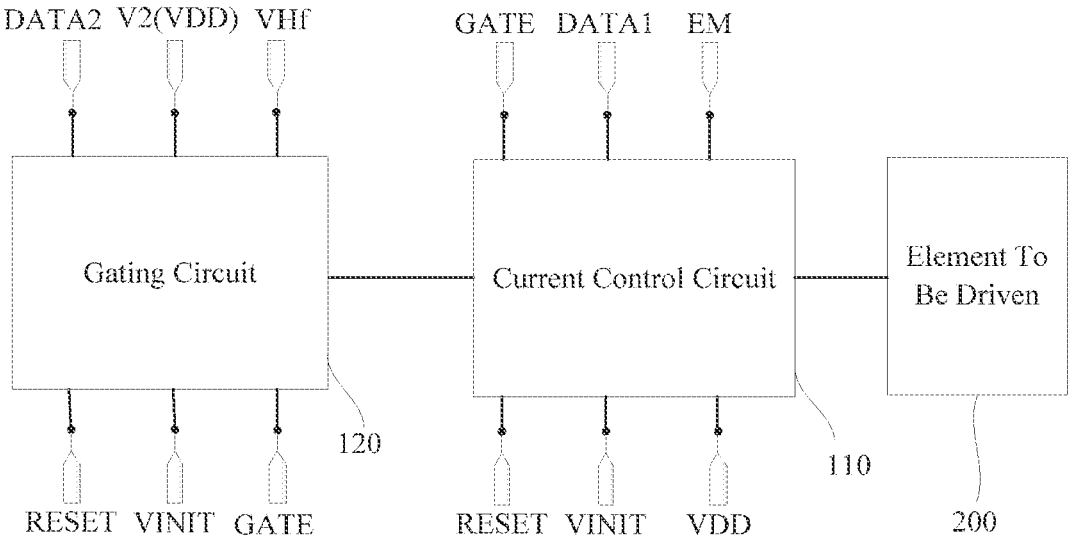
FIG. 3B is a block diagram of a structure of another pixel driving circuit according to an embodiment of the present disclosure.

Referring to FIG. 3A or FIG. 3B, the pixel driving circuit 100 included in the display panel 1100 provided by an embodiment of the present disclosure includes: a current control circuit 110 and a gating circuit 120.

The current control circuit 110 is coupled to the scan signal terminal GATE, the first data signal terminal DATA1, the first voltage signal terminal VDD, the enable signal terminal EM, and the element to be driven 200. The current control circuit 110 is configured to transmit a driving current signal to the element to be driven 200 according to the first data signal Data1 from the first data signal terminal DATA1 under the control of the scan signal Gate from the scan signal terminal GATE and the enable signal Em from the enable signal terminal EM, such that the element to be driven 200 emits light according to the driving current signal transmitted by the current control circuit 110.

The scan signal terminal GATE is coupled to the scan signal line G, and configured to receive the scan signal Gate from the scan signal line G, and transmit the scan signal Gate to the current control circuit 110.

The first data signal terminal DATA1 is coupled to the first data signal line D1, and configured to receive the first data signal Data1 from the first data signal line D1, and transmit the first data signal Data1 to the current control circuit 110.

The first voltage signal terminal VDD is coupled to the first voltage signal line $L_{VDD}$, and configured to receive the first voltage signal Vdd from the first voltage signal line $L_{VDD}$, and transmit the first voltage signal Vdd to the current control circuit 110.

The enable signal terminal EM is coupled to the enable signal line E, and configured to receive the enable signal Em from the enable signal line E, and transmit the enable signal Em to the current control circuit 110.

Referring to FIGS. 3A and 3B, the gating circuit 120 is coupled to the scan signal terminal GATE, the reset signal terminal RESET, the second data signal terminal DATA2, a second voltage signal terminal V2, and a third voltage signal terminal VHf. The gating circuit 120 is configured to transmit the second voltage signal V02 from the second voltage signal terminal V2 to the element to be driven 200 according to the second data signal Data2 from the second data signal terminal DATA2, such that the element to be driven 200 continuously emits light; or transmit the third voltage signal Vhf from the third voltage signal terminal VHf to the element to be driven 200 according to the second data signal Data2 from the second data signal terminal DATA2, such that the element to be driven 200 intermittently emits light, under the control of the scan signal Gate from the scan signal terminal GATE and the reset signal Reset from the reset signal terminal RESET.

FIG. 3A is a structural diagram of the pixel driving circuit where the second voltage signal terminal V2 is a VSS voltage signal terminal, i.e., the second voltage signal terminal V2 (VSS); in this situation, the second voltage signal is a Vss signal. FIG. 3B is a structural diagram of the pixel driving circuit where the second voltage signal terminal V2 is the VDD voltage signal terminal, i.e. the second voltage signal terminal V2 (VDD); in this situation, the second voltage signal is a Vdd signal.

The reset signal terminal RESET is coupled to the reset signal line R, and configured to receive the reset signal Reset from the reset signal line R. and transmit the reset signal Reset to the gating circuit 120.

The second data signal terminal DATA2 is coupled to the second data signal line D2, and configured to receive the second data signal Data2 from the second data signal line D2, and transmit the second data signal Data2 to the gating circuit 120.

Figure 4A:
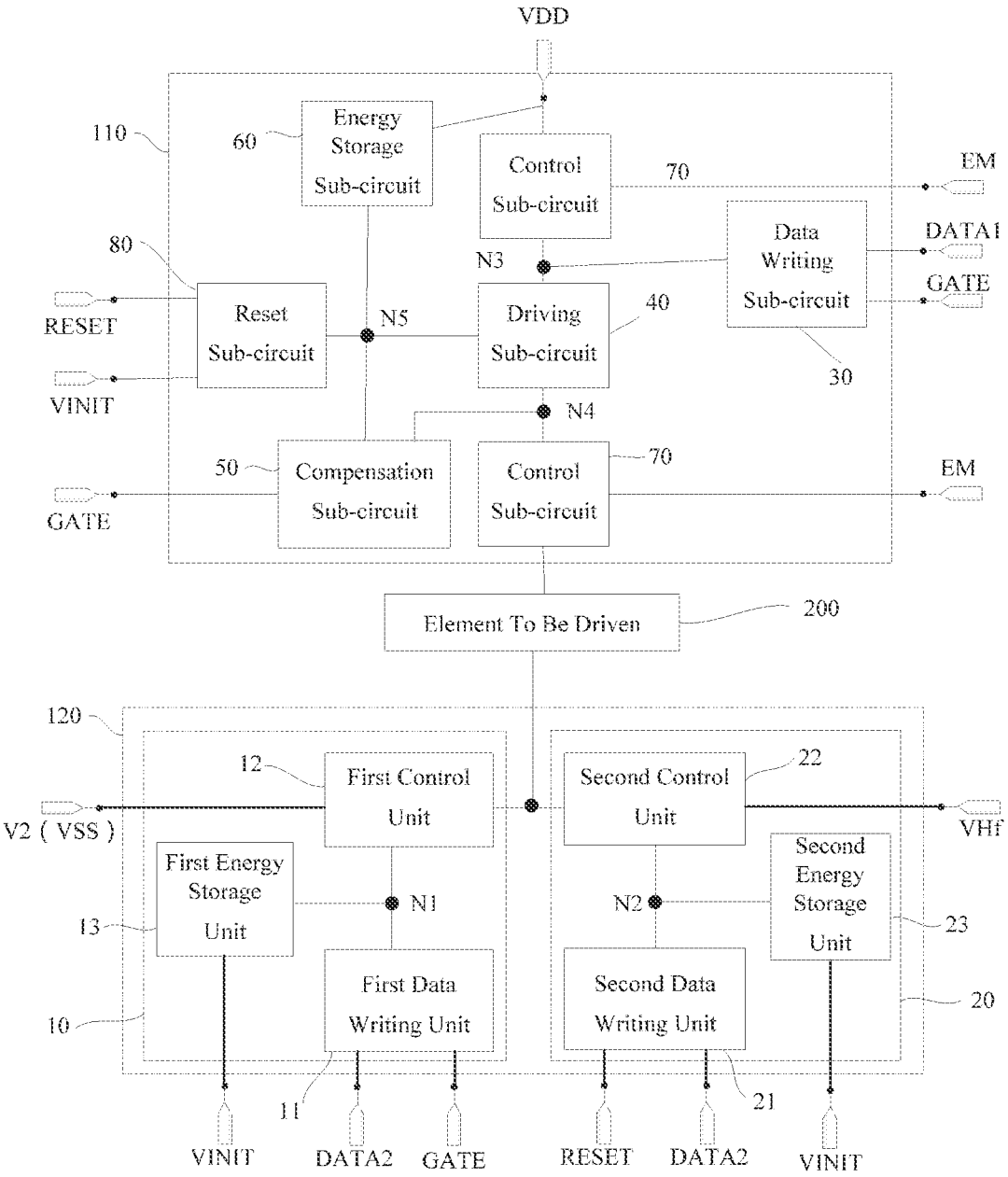
FIG. 4A is a structural diagram of a gating circuit according to an embodiment of the present disclosure.
Figure 5:
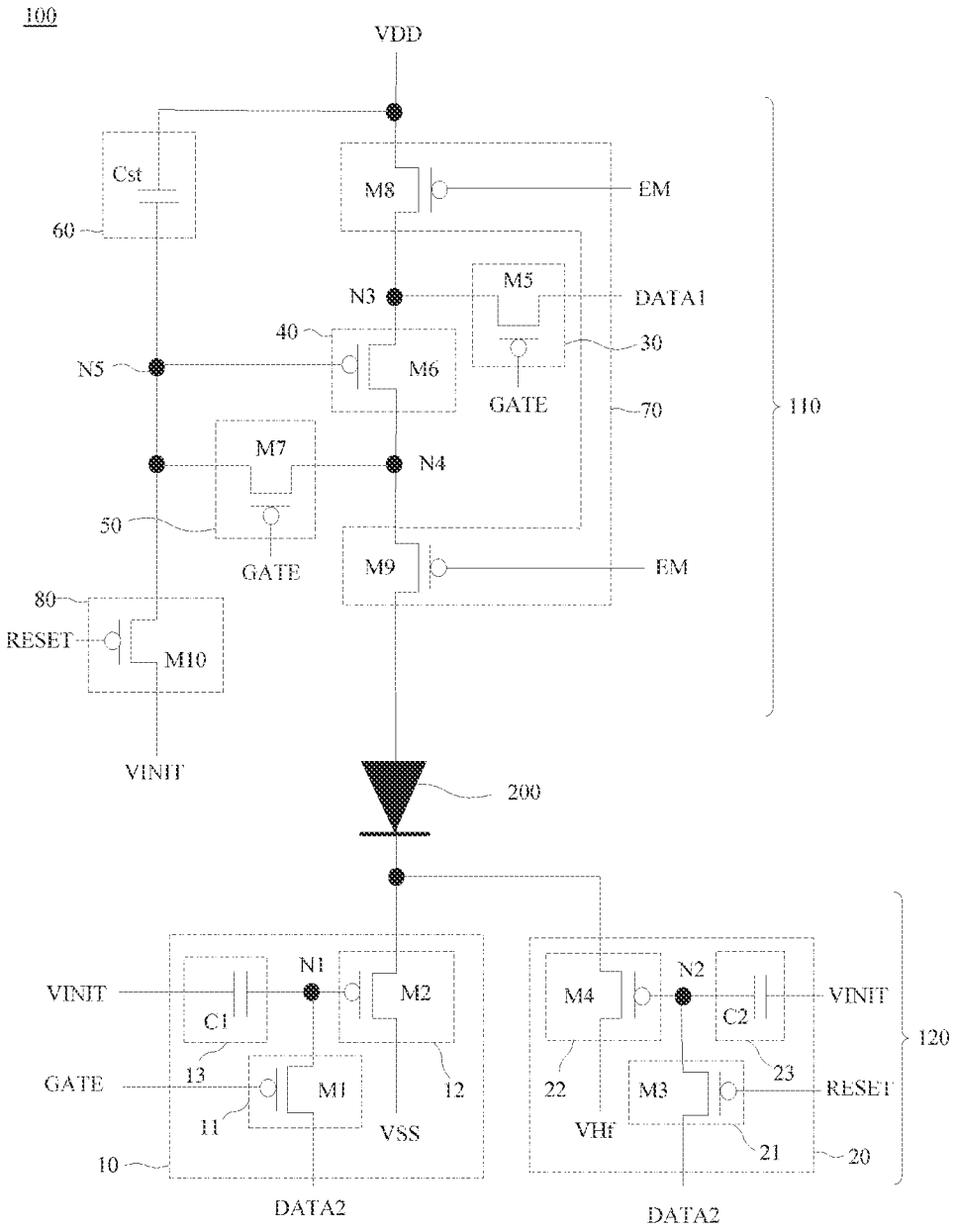
FIG. 5 is a structural diagram of a pixel driving circuit according to an embodiment of the present disclosure.

In some embodiments, as shown in FIG. 3A, FIG. 4A and FIG. 5, the current control circuit 110 is coupled to the first electrode of the element to be driven 200, the gating circuit 120 is coupled to the second electrode of the element to be driven 200, and a voltage signal transmitted by the second voltage signal terminal V2 (VSS voltage signal terminal) is different from a voltage signal transmitted by the first voltage signal terminal VDD. Thus, the second voltage signal terminal V2 is coupled to the second voltage signal line LVSS, and the second voltage signal terminal V2 is a VSS voltage signal terminal; the second voltage signal terminal V2 (VSS) is configured to receive the voltage signal Vss from the second voltage signal line LVSS and provide the voltage signal Vss to the gating circuit 120 (the gating circuit 120 is directly coupled to the second electrode of the element to be driven 200).

Figure 4B:
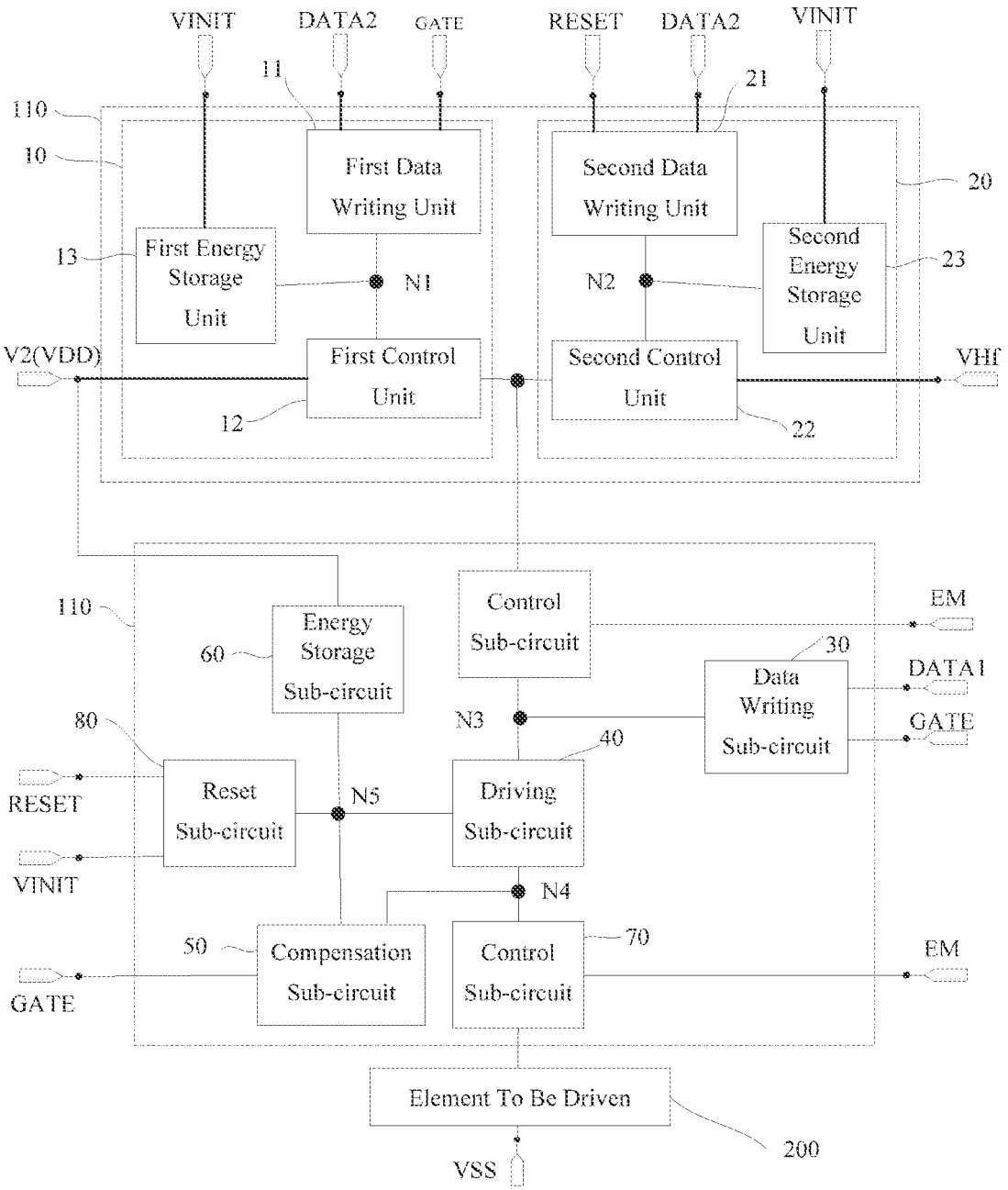
FIG. 4B is a structural diagram of another gating circuit according to an embodiment of the present disclosure.
Figure 8:
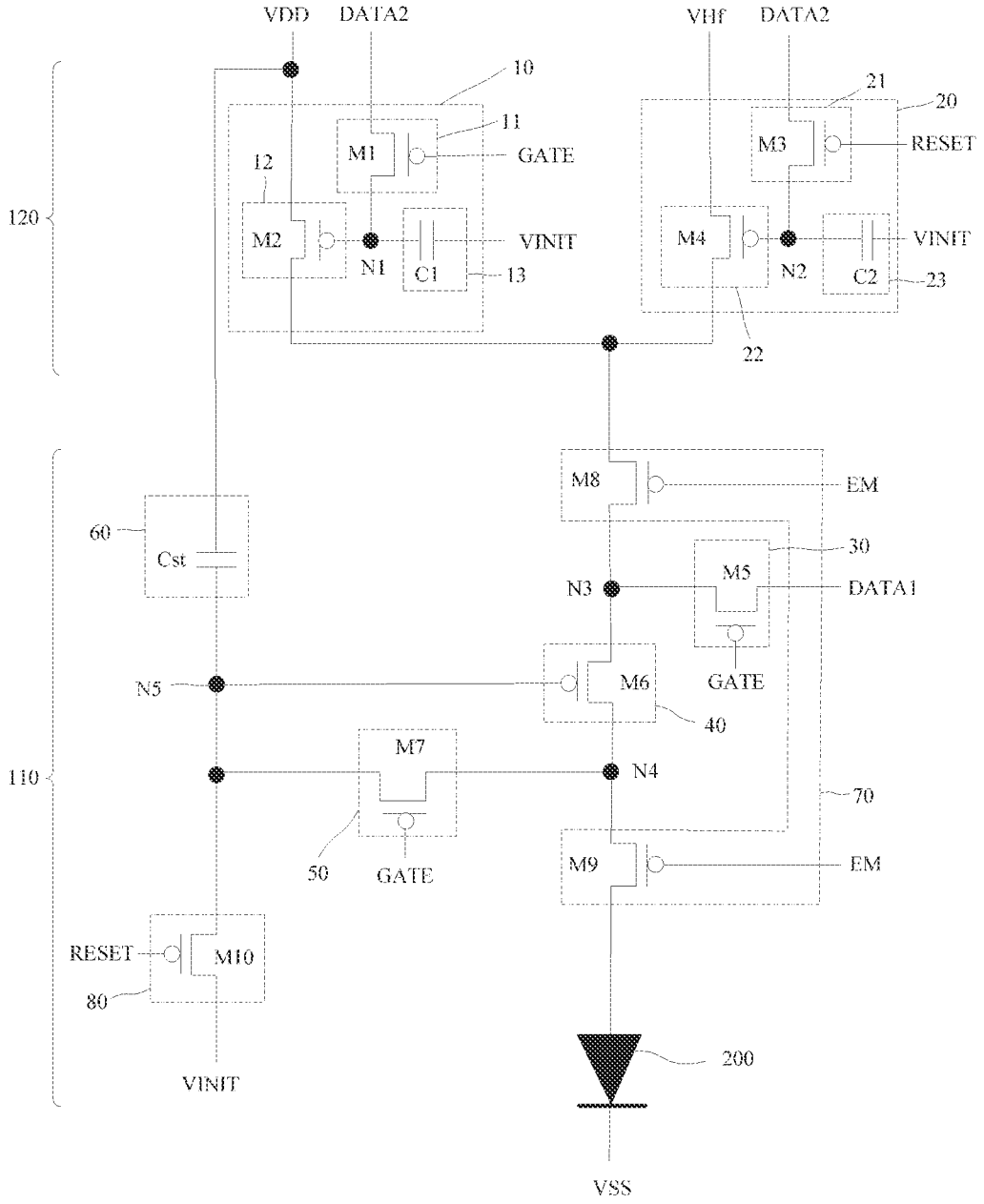
FIG. 8 is a structural diagram of another pixel driving circuit according to an embodiment of the present disclosure.

In some embodiments, as shown in FIGS. 3B, 4B and 8, the current control circuit 110 is coupled to the first electrode of the element 120 to be driven, the gating circuit 120 is coupled to the current control circuit 110, and a voltage signal transmitted by the second voltage signal terminal V2 is the same as a voltage signal transmitted by the first voltage signal terminal VDD. Thus, the second voltage signal terminal V2 is coupled to the first voltage signal line $L_{VDD}$, and the second voltage signal terminal V2 is a VDD voltage signal terminal; the second voltage signal terminal V2 (VDD) is configured to receive the first voltage signal Vdd from the first voltage signal line $L_{VDD}$ and provide the first voltage signal Vdd to the gating circuit 120 (the gating circuit 120 is indirectly coupled to the first electrode of the element to be driven 200 through the current control circuit 110).

The third voltage signal terminal VHf is coupled to the third voltage signal line LVHf, and is configured to receive the third voltage signal Vhf from the third voltage signal line LVHf and provide the third voltage signal Vhf to the gating circuit 120.

The second voltage signal terminal V2 is a signal terminal (VDD voltage signal terminal or VSS voltage signal terminal) for transmitting a DC (direct current) voltage signal. The third voltage signal terminal VHf is a signal terminal for transmitting a pulse voltage signal.

In some embodiments, a frequency range of the pulse voltage signal is 3000 Hz to 60000 Hz; for example, a frequency of the pulse voltage signal may be 3000 Hz, 10000 Hz, 60000 Hz, or the like. If the frequency of the pulse voltage signal is too low, the flicker is easily perceived by human eyes, influencing the appearance; if the frequency of the pulse voltage signal is too high, hardware, such as an IC, is difficult to implement the high frequency.

For all circuits included in the display panel, the frequency of the pulse voltage signal is constant, and is always a preset frequency or fluctuates in a small range near the preset frequency.

In the pixel driving circuit 100 provided by the embodiment of the present disclosure, the second voltage signal V02 or the third voltage signal Vhf may be input to the element to be driven 200 under the control of the gating circuit 120; and in the case where the gating circuit 120 inputs the second voltage signal V02 to the element to be driven 200, the element to be driven 200 continuously emits light; in the case where the gating circuit 120 inputs the third voltage signal Vhf to the element to be driven 200, the element to be driven 200 intermittently emits light.

Therefore, when the display luminance of the element to be driven 200 is required to be a high gray scale, the second voltage signal V02 may be input to the element to be driven 200 by the gating circuit 120, so that the element to be driven 200 may continuously emit light in one frame; and the magnitude of the current flowing through the element to be driven 200 is controlled by the first data signal Data1 from the first data signal terminal DATA1, so as to control the element to be driven 200 to display different high gray scales.

When the display luminance of the element to be driven 200 is required to be a low gray scale, the third voltage signal Vhf may be input to the element to be driven 200 by the gating circuit 120, so that the element to be driven 200 intermittently emits light in one frame, and thus, the light emitting duration of the element to be driven 200 in one frame is shortened; further, without reducing the light emitting intensity of the element to be driven 200 (without reducing the current flowing through the element to be driven 200 when the element to be driven 200 emits light), the luminance (gray scale) of the element to be driven 200 perceived by human eyes is reduced, so that the element to be driven 200 displays a low gray scale at a higher current. Thus, the current magnitude of the element to be driven 200 when displaying the low gray scale may be increased, so that the current transmitted to the element to be driven 200 is larger, and the element to be driven 200 may display a high gray scale and a low gray scale at high current density, thereby enabling the element to be driven 200 to realize full gray scale display.

In some embodiments, referring to FIGS. 4A and 4B, the gating circuit 120 includes a first gating sub-circuit 10 and a second gating sub-circuit 20.

The first gating sub-circuit 10 is coupled to the scan signal terminal GATE, the second data signal terminal DATA2, and the second voltage signal terminal V2; FIG. 4A is a structural diagram of the gating circuit 120 where the second voltage signal terminal is the VSS voltage signal terminal; FIG. 4B is a structural diagram of the gating circuit 120 where the second voltage signal terminal is the VDD voltage signal terminal. The first gating sub-circuit 10 is configured to transmit the second voltage signal V02 from the second voltage terminal VDD/VSS to the element to be driven 200 under the control of the scan signal Gate from the scan signal terminal GATE and the second data signal Data2 from the second data signal terminal DATA2, such that the element to be driven 200 continuously emits light.

The second gating sub-circuit 20 is coupled to the reset signal terminal RESET, the second data signal terminal DATA2, and the third voltage signal terminal VHf. The second gating sub-circuit is configured to transmit the third voltage signal Vhf from the third voltage terminal VHf to the element to be driven 200 under the control of the reset signal Reset from the reset signal terminal RESET and the second data signal Data2 from the second data signal terminal DATA2, such that the element to be driven 200 intermittently emits light.

In this way, in the case where the display luminance of the element to be driven 200 is required to be a high gray scale, the third voltage signal terminal VHf is (electrically) disconnected from the element to be driven 200 under the control of the reset signal Reset and the second data signal Data2; meanwhile, under the control of the scan signal Gate and the second data signal Data2, the second voltage signal terminal V2 is (electrically) connected to the element to be driven 200, such that the element to be driven 200 continuously emits light. In this way, when the element to be driven 200 displays the high gray scale, the element to be driven 200 continuously emits light.

In the case where the element to be driven 200 is required to display a low gray scale, the second voltage signal terminal V2 is disconnected from the element to be driven 200 under the control of the scan signal Gate and the second data signal Data2; meanwhile, under the control of the reset signal Reset and the second data signal Data2, the third voltage signal terminal VHf is connected to the element to be driven 200, such that the element to be driven 200 intermittently emits light. In this way, when the element to be driven 200 displays the low gray scale, the element to be driven 200 intermittently emits light.

Referring to FIGS. 4A and 4B, the first gating sub-circuit 10 includes a first data writing unit 11, a first control unit 12, and a first energy storage unit 13.

The first data writing unit 11 is coupled to the scan signal terminal GATE, the second data signal terminal DATA2, and a first node N1; the first data writing unit 11 is configured to transmit the second data signal Data2 from the second data signal terminal DATA2 to the first node N1 under the control of the scan signal Gate from the scan signal terminal GATE. The first data writing unit 11 transmits the second data signal Data2 to the first node N1 during a scan phase T2 (see FIGS. 6 to 7 and 9 to 10).

The first control unit 12 is coupled to the first node N1, the second voltage signal terminal DATA2 and the element to be driven 200; the first control unit 12 is configured to transmit the second voltage signal V02 from the second voltage signal terminal V2 to the element to be driven 200 under the control of a voltage at the first node N1. The first control unit 12 controls the connection of the second voltage signal terminal V2 to the element to be driven 200 according to the second data signal Data2 at the first node N1 during a light emitting phase T3 (see FIGS. 6 to 7 and FIG. 9 to 10). When the second voltage signal terminal V2 is connected to the element to be driven 200, the element to be driven 200 continuously emits light under the driving of the second voltage signal V02.

The first energy storage unit 13 is coupled to the initialization signal terminal VINIT and the first node N1; the first energy storage unit 13 is configured to store and maintain the voltage at the first node N1. During the scan phase T2, the first energy storage unit 13 stores the second data signal Data2 received by the first node N1 from the second data signal terminal DATA2; during the light emitting phase T3, the voltage at the first node N1 is kept stable.

Referring to FIG. 4A or 4B, the second gating sub-circuit 20 includes: a second data writing unit 21, a second control unit 22, and a second energy storage unit 23.

The second data writing unit 21 is coupled to the reset signal terminal RESET, the second data signal terminal DATA2, and a second node N2; the second data writing unit 21 is configured to transmit the second data signal Data2 from the second data signal terminal DATA2 to the second node N2 under the control of the reset signal Reset from the reset signal terminal RESET. The second data writing unit 21 transmits the second data signal Data2 to the second node N2 during a reset phase T1 (see FIGS. 6 to 7 and 9 to 10).

The second control unit 22 is coupled to the second node N2 and the third voltage signal terminal VHf; the second control unit 22 is configured to transmit the third voltage signal Vhf from the third voltage terminal VHf to the element to be driven 200 under the control of a voltage at the second node N2. The second control unit 22 controls the connection of the third voltage signal terminal VHf to the element to be driven 200 according to the second data signal Data2 at the second node N2 during the light emitting phase T3.

The second energy storage unit 23 is coupled to the initialization signal terminal VINIT and the second node N2; the second energy storage unit 23 is configured to store and maintain the voltage at the second node N2. The second energy storage unit 23 stores the second data signal Data2 received by the second node N2 from the second data signal terminal DATA2 during the scan phase T2; during the light emitting phase T3, the voltage at the second node N2 is kept stable.

During the reset phase T1, the second data signal Data2 of the second data signal terminal DATA2 is transmitted to the second node N2. During the scan phase T2, the second data signal Data2 of the second data signal terminal DATA2 is transmitted to the first node N1. During the light emitting phase T3, the first control unit 12 controls the connection of the second voltage signal terminal V2 to the element to be driven 200 according to the voltage at the first node N1, and the second control unit 22 controls the connection of the third voltage signal terminal VHf to the element to be driven 200 according to the voltage at the second node N2. When the third voltage signal terminal VHf is connected to the element to be driven 200, the element to be driven 200 intermittently emits light under the driving of the third voltage signal Vhf.

For example, the pixel driving circuit shown in FIG. 4A and FIG. 5 is taken as an example; referring to FIGS. 4A, 5, 6 and 7, in the case where the element to be driven 200 is required to display a high gray scale, the second data signal terminal DATA2 inputs a high level signal to the second node N2 during the reset phase T1; during the scan phase T2, the second data signal terminal DATA2 inputs a low level signal to the first node N1; during the light emitting phase T3, the second control unit 22 disconnects the third voltage signal terminal VHf from the element to be driven 200 under the control of the high level signal at the second node N2; and the first control unit 12 connects the second voltage signal terminal V2 to the element to be driven 200 under the control of the low level signal at the first node N1; the gating circuit 120 transmits the second voltage signal V02 of the second voltage signal terminal V2 to the element to be driven 200, such that the element to be driven 200 continuously emits light. In the case where the display luminance of the element to be driven 200 is required to be a low gray scale, the low level signal is input to the second data signal terminal DATA2 during the reset phase T1, and the high level signal is input to the second data signal terminal DATA2 during the scan phase T2, and the operation process of the gating circuit 120 is not described here again.

In some embodiments, referring to FIGS. 5 and 8, the first data writing unit 11 includes a first transistor M1; a control electrode of the first transistor M1 is coupled to the scan signal terminal GATE, a first electrode of the first transistor M1 is coupled to the second data signal terminal DATA2, and a second electrode of the first transistor M1 is coupled to the first node N1. The first control unit 12 includes a second transistor M2; a control electrode of the second transistor M2 is coupled to the first node N1, a first electrode of the second transistor M2 is coupled to the second voltage signal terminal V2, and a second electrode of the second transistor M2 is coupled to the element to be driven 200 (as shown in FIG. 5) or the current control circuit 110 (as shown in FIG. 8). The first energy storage unit 13 includes a first capacitor C1, a first terminal of the first capacitor C1 is coupled to the initialization signal terminal VINIT, and a second terminal of the first capacitor C1 is coupled to the first node N1.

During the scan phase T2, the first transistor M1 is turned on under the control of the scan signal Gate of the scan signal terminal GATE, and the second data signal Data2 of the second data signal terminal DATA2 is transmitted to the first node N1 through the first transistor M1; the first capacitor C1 stores the voltage at the first node N1. During the light emitting phase T3, the first capacitor C1 maintains the voltage at the first node N1, and the second transistor M2 is maintained to be turned on or off under the control of the voltage at the first node N1.

In some embodiments, referring to FIGS. 5 and 8, the second data writing unit 21 includes a third transistor M3, a control electrode of the third transistor M3 is coupled to the reset signal terminal RESET, a first electrode of the third transistor M3 is coupled to the second data signal terminal DATA2, and a second electrode of the third transistor M3 is coupled to the second node N2. The second control unit 22 includes a fourth transistor M4, a control electrode of the fourth transistor M4 is coupled to the second node N2, a first electrode of the fourth transistor M4 is coupled to the third voltage signal terminal VHf, and a second electrode of the fourth transistor M4 is coupled to the element to be driven 200 (shown in FIG. 5) or the current control circuit 110 (shown in FIG. 8). The second energy storage unit 23 includes a second capacitor C2, a first terminal of the second capacitor C2 is coupled to the initialization signal terminal VINIT, and a second terminal of the second capacitor C2 is coupled to the second node N2.

During the reset phase T1, the third transistor M3 is turned on under the control of the reset signal Reset of the reset signal terminal RESET, and the second data signal Data2 of the second data signal terminal DATA2 is transmitted to the second node N2 through the third transistor M3; the second capacitor C2 stores the voltage at the second node N2.

During the light emitting phase T3, the second capacitor C2 maintains the voltage at the second node N2, and the fourth transistor M4 is maintained to be turned on or off under the control of the voltage at the second node N2.

In some embodiments, referring to FIGS. 4A, 4B, 5, and 8, the current control circuit 110 includes: a data writing sub-circuit 30, a driving sub-circuit 40, a compensation sub-circuit 50, an energy storage sub-circuit 60, a control sub-circuit 70, and a reset sub-circuit 80.

The data writing sub-circuit 30 is coupled to the scan signal terminal GATE, the first data signal terminal DATA1 and the third node N3. The data writing sub-circuit 30 is configured to transmit the first data signal Data1 from the first data signal terminal DATA1 to the third node N3 under the control of the scan signal Gate from the scan signal terminal GATE. The data writing sub-circuit 30 transmits the first data signal Data1 to the third node N3 during the scan phase T2.

The driving sub-circuit 40 is coupled to the third node N3, a fourth node N4, and a fifth node N5. The driving sub-circuit 40 is configured to be turned on under the control of a voltage at the fifth node N5. The driving sub-circuit 40 is turned on under the control of the voltage at the fifth node N5 during the light emitting phase T3.

The compensation sub-circuit 50 is coupled to the scan signal terminal GATE, the fourth node N4, and the fifth node N5. The compensation sub-circuit 50 is configured to compensate the voltage at the fifth node N5 under the control of the scan signal Gate from the scan signal terminal GATE, so that the voltage at the fifth node N5 is related to a threshold voltage of the driving sub-circuit 50. The compensation sub-circuit 50 connects the fourth node N4 to the fifth node N5 during the scan phase T2, so that the voltage at the fifth node N5 is related to the threshold voltage of the driving sub-circuit 50.

The energy storage sub-circuit 60 is coupled to the fifth node N5 and the first voltage signal terminal VDD; the energy storage sub-circuit 60 is configured to store and maintain the voltage at the fifth node N5. The energy storage sub-circuit 60 stores the voltage received by the fifth node N5 from the fourth node N4 during the scan phase T2, and keeps the voltage at the fifth node N5 stable during the light emitting phase T3.

The control sub-circuit 70 is coupled to the enable signal terminal EM, the third node N3, the fourth node N4, and the element to be driven 200. The control sub-circuit 70 is further coupled to the first voltage signal terminal VDD (shown in FIG. 5) or the gating circuit 120 (shown in FIG. 8); the control sub-circuit 70 is configured to transmit a driving current signal to the element to be driven 200 in cooperation with the driving sub-circuit 40 under the control of the enable signal Em from the enable signal terminal EM.

The reset sub-circuit 80 is coupled to the reset signal terminal RESET, the initialization signal terminal VINIT, and the fifth node N5. The reset sub-circuit 80 is configured to transmit the initialization voltage signal Vinit from the initialization signal terminal VINIT to the fifth node N5 under the control of the reset signal Reset from the reset signal terminal RESET. The reset sub-circuit 80 transmits the initialization voltage signal Vinit to the fifth node N5 during the reset phase T1.

Figure 6:
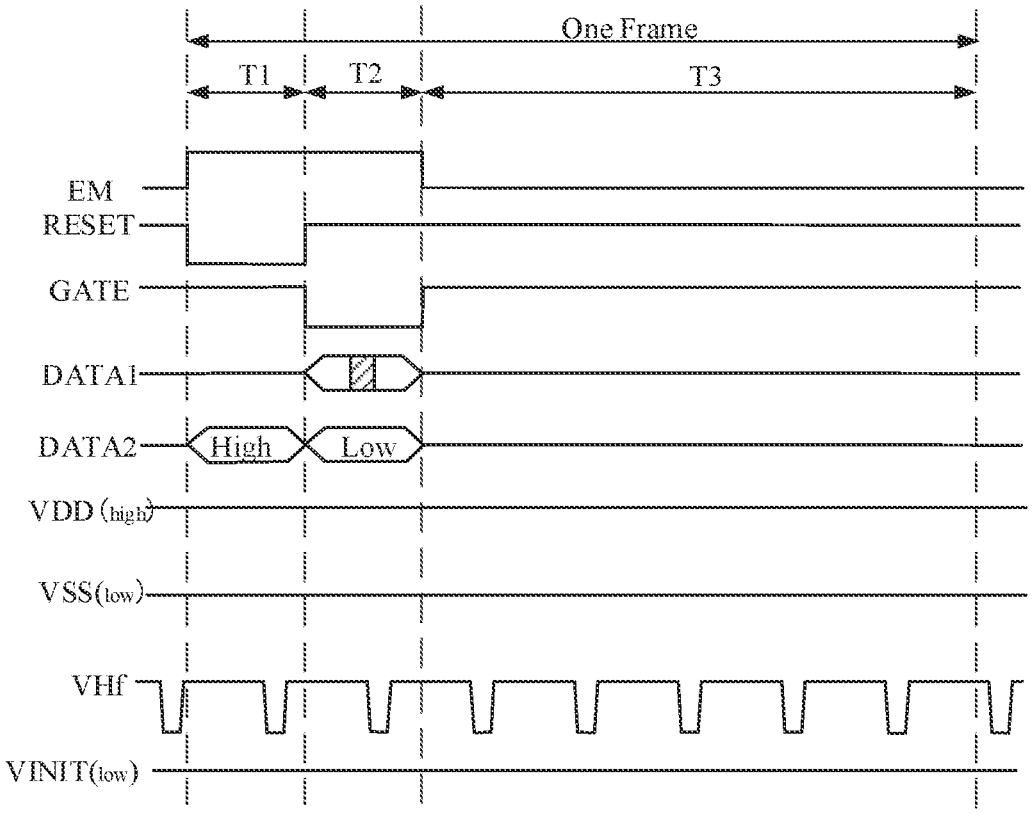
FIG. 6 is a timing diagram when the pixel driving circuit shown in FIG. 5 is displaying a high gray scale.
Figure 7:
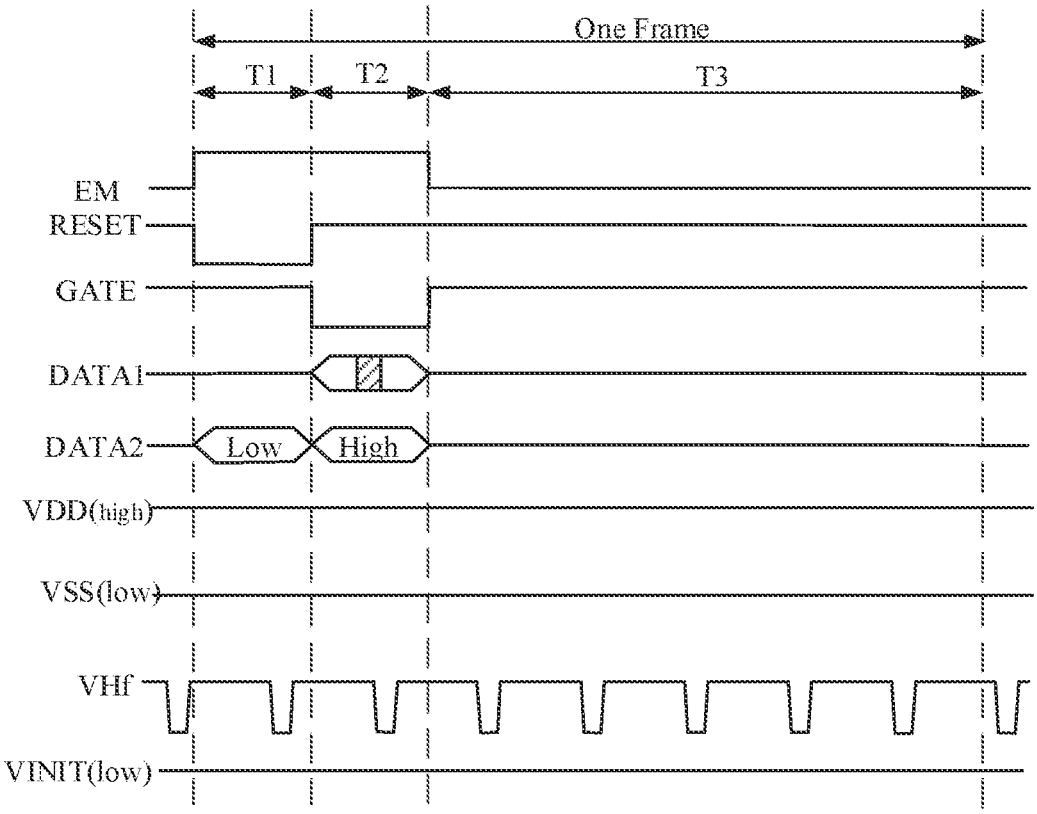
FIG. 7 is a timing diagram when the pixel driving circuit shown in FIG. 5 is displaying a low gray scale.

For example, by taking the pixel driving circuit shown in FIG. 5 as an example, the control sub-circuit 70 is coupled to the first voltage signal terminal VDD. Referring to FIGS. 5, 6 and 7, in the current control circuit 110, during the reset phase T1, the reset sub-circuit 80 transmits the initialization voltage signal Vinit to the fifth node N5, and clears the first data signal Data1 of the previous frame stored at the fifth node; the energy storage sub-circuit 60 stores the voltage at the fifth node N5; the voltage at the fifth node N5 is related to the initialization voltage signal Vinit, and the voltage at the fifth node N5 may control the driving sub-circuit 40 to be turned on. During the scan phase T2, the data writing sub-circuit 30 transmits the first data signal Data1 to the third node N3; the driving sub-circuit 40 is turned on; the voltage at the fifth node is compensated through the compensation sub-circuit 50; the energy storage sub-circuit 60 stores the voltage at the fifth node N5. During the light emitting phase, the control sub-circuit 70 transmits a driving current to the element to be driven 200 in cooperation with the driving sub-circuit 40; the magnitude of the driving current is related to the first voltage signal Vdd of the first voltage signal terminal VDD and the voltage at the fifth node N5.

In some embodiments, referring to FIGS. 5 and 8, the data writing sub-circuit 30 includes a fifth transistor M5, a control electrode of the fifth transistor M5 is coupled to the scan signal terminal GATE, a first electrode of the fifth transistor M5 is coupled to the first data signal terminal DATA1, and a second electrode of the fifth transistor M5 is coupled to the third node N3. During the scan phase T2, the fifth transistor M5 is turned on under the control of the scan signal Gate from the scan signal terminal GATE, and the first data signal Data1 of the first data signal terminal DATA1 is transmitted to the third node N3.

Referring to FIGS. 5 and 8, the driving sub-circuit 40 includes a sixth transistor M6, a control electrode of the sixth transistor M6 is coupled to the fifth node N5, a first electrode of the sixth transistor M6 is coupled to the third node N3, and a second electrode of the sixth transistor M6 is coupled to the fourth node N4. During the scan phase T2 and the light emitting phase T3, the sixth transistor M6 is turned on under the control of the voltage at the fifth node N5.

Referring to FIGS. 5 and 8, the compensation sub-circuit 50 includes a seventh transistor M7, a control electrode of the seventh transistor M7 is coupled to the scan signal terminal GATE, a first electrode of the seventh transistor M7 is coupled to the fourth node N4, and a second electrode of the seventh transistor M7 is coupled to the fifth node N5. During the scan phase T2, the seventh transistor M7 is turned on under the control of the scan signal Gate from the scan signal terminal GATE, and the fourth node N4 is connected to the fifth node N5, so that the voltage at the fifth node N5 is related to a threshold voltage of the sixth transistor M6.

Referring to FIGS. 5 and 8, the energy storage sub-circuit 60 includes a third capacitor Cst, a first terminal of the third capacitor Cst is coupled to the first voltage signal terminal VDD, and a second terminal of the third capacitor Cst is coupled to the fifth node N5. During the scan phase T2, the third capacitor Cst stores the voltage received by the fifth node N5 from the fourth node N4; during the light emitting phase T3, the third capacitor Cst keeps the voltage at the fifth node N5 stable, and puts the sixth transistor M6 in a turned-on state.

Referring to FIGS. 5 and 8, the control sub-circuit 70 includes an eighth transistor M8 and a ninth transistor M9; a control electrode of the eighth transistor M8 is coupled to the enable signal terminal EM, a first electrode of the eighth transistor M8 is coupled to the first voltage signal terminal VDD or the gating circuit 120, and a second electrode of the eighth transistor M8 is coupled to the third node N3; a control electrode of the ninth transistor M9 is coupled to the enable signal terminal EM, a first electrode of the ninth transistor M9 is coupled to the fourth node N4, and a second electrode of the ninth transistor M9 is coupled to the element to be driven 200. During the light emitting phase T3, the eighth transistor M8 and the ninth transistor M9 are turned on under the control of the enable signal Em from the enable signal terminal EM, and transmit a driving current signal to the element to be driven 200 in cooperation with the sixth transistor M6.

Referring to FIGS. 5 and 8, the reset sub-circuit includes a tenth transistor M10, a control electrode of the tenth transistor M10 is coupled to the reset signal terminal RESET, a first electrode of the tenth transistor M10 is coupled to the initialization signal terminal VINIT, and a second electrode of the tenth transistor M10 is coupled to the fifth node N5. During the reset phase T1, the tenth transistor M10 is turned on under the control of the reset signal Reset from the reset signal terminal RESET, and transmits the initialization voltage signal Vinit to the fifth node N5.

For example, by taking the pixel driving circuit shown in FIG. 5 as an example, the control sub-circuit 70 is coupled to the first voltage signal terminal VDD. Referring to FIGS. 5, 6 and 7, in the current control circuit 110, during the reset phase T1, the tenth transistor M10 is turned on under the control of the reset signal Reset from the reset signal terminal RESET, transmits the initialization voltage signal Vinit to the fifth node N5, and clears the first data signal Data1 of the previous frame stored at the fifth node; the third capacitor Cst stores a voltage at the fifth node N5; wherein, the initialization voltage signal Vinit is a low level signal. During the scan phase T2, the fifth transistor M5 is turned on under the control of the scan signal Gate from the scan signal terminal GATE, such that the first data signal Data1 of the first data signal terminal DATA1 is transmitted to the third node N3; the sixth transistor M6 is turned on under the control of the voltage at the fifth node N5; the seventh transistor M7 is turned on under the control of the scan signal Gate from the scan signal terminal GATE, and connects the fourth node N4 to the fifth node N5, such that the voltage at the fifth node N5 is related to a threshold voltage of the sixth transistor M6, so that the voltage at the fifth node N5 is compensated. During the light emitting phase T3, the eighth transistor M8 and the ninth transistor M9 are turned on under the control of the enable signal Em from the enable signal terminal EM, the sixth transistor M6 is turned on under the control of the compensated voltage at the fifth node N5, and the control sub-circuit 70 transmits a driving current signal to the element to be driven 200.

In some embodiments, referring to FIG. 5, the current control circuit 110 is coupled to a first electrode of the element to be driven 200, the gating circuit 120 is coupled to a second electrode of the element to be driven 200, and a voltage signal transmitted by the second voltage signal terminal V2 (VSS) is different from a voltage signal transmitted by the first voltage signal terminal VDD. Thus, the current control circuit 110 includes:

a fifth transistor M5, wherein a control electrode of the fifth transistor M5 is coupled to the scan signal terminal GATE, a first electrode of the fifth transistor M5 is coupled to the first data signal terminal DATA1, and a second electrode of the fifth transistor M5 is coupled to the third node N3;

a sixth transistor M6, wherein a control electrode of the sixth transistor M6 is coupled to the fifth node N5, a first electrode of the sixth transistor M6 is coupled to the third node N3, and a second electrode of the sixth transistor M6 is coupled to the fourth node N4;

a seventh transistor M7, wherein a control electrode of the seventh transistor M7 is coupled to the scan signal terminal GATE, a first electrode of the seventh transistor M7 is coupled to the fourth node N4, and a second electrode of the seventh transistor M7 is coupled to the fifth node N5;

an eighth transistor M8, wherein a control electrode of the eighth transistor M8 is coupled to the enable signal terminal EM, a first electrode of the eighth transistor M8 is coupled to the first voltage signal terminal VDD, and a second electrode of the eighth transistor M8 is coupled to the third node N3;

a ninth transistor M9, wherein a control electrode of the ninth transistor M9 is coupled to the enable signal terminal EM, a first electrode of the ninth transistor M9 is coupled to the fourth node N4, and a second electrode of the ninth transistor M9 is coupled to the element to be driven 200;

a tenth transistor M10, wherein a control electrode of the tenth transistor M10 is coupled to the reset signal terminal RESET, a first electrode of the tenth transistor M10 is coupled to the initialization signal terminal VINIT, and a second electrode of the tenth transistor M10 is coupled to the fifth node N5;

a third capacitor Cst, wherein a first terminal of the third capacitor Cst is coupled to the first voltage signal terminal VDD, and a second terminal of the third capacitor Cst is coupled to the fifth node N5.

Continue to refer to FIG. 5, the gating circuit 110 includes:

a first transistor M1, wherein a control electrode of the first transistor M1 is coupled to the scan signal terminal GATE, a first electrode of the first transistor M1 is coupled to the second data signal terminal DATA2, and a second electrode of the first transistor M1 is coupled to the first node N1;

a second transistor M2; wherein a control electrode of the second transistor M2 is coupled to the first node N1, a first electrode of the second transistor M2 is coupled to the second voltage signal terminal V2 (VSS), and a second electrode of the second transistor M2 is coupled to the element to be driven 200;

a first capacitor C1, wherein a first terminal of the first capacitor C1 is coupled to the initialization signal terminal VINIT, and a second terminal of the first capacitor C1 is coupled to the first node N1;

a third transistor M3, wherein a control electrode of the third transistor M3 is coupled to the reset signal terminal RESET, a first electrode of the third transistor M3 is coupled to the second data signal terminal DATA2, and a second electrode of the third transistor M3 is coupled to the second node N2;

a fourth transistor M4, wherein a control electrode of the fourth transistor M4 is coupled to the second node N2, a first electrode of the fourth transistor M4 is coupled to the third voltage signal terminal VHf, and a second electrode of the fourth transistor M4 is coupled to the element to be driven 200;

a second capacitor C2, wherein a first terminal of the second capacitor C2 is coupled to the initialization signal terminal VINIT, and a second terminal of the second capacitor C2 is coupled to the second node N2.

In some embodiments, referring to FIG. 8, the current control circuit 110 is coupled to the first electrode of the element to be driven 200, the gating circuit 120 is coupled to the current control circuit 110, and the voltage signal transmitted by the second voltage signal terminal V2 (VDD) is the same as the voltage signal transmitted by the first voltage signal terminal VDD. Thus, the current control circuit includes:

a fifth transistor M5, wherein a control electrode of the fifth transistor M5 is coupled to the scan signal terminal GATE, a first electrode of the fifth transistor M5 is coupled to the first data signal terminal DATA1, and a second electrode of the fifth transistor M5 is coupled to the third node N3;

a sixth transistor M6, wherein a control electrode of the sixth transistor M6 is coupled to the fifth node N5, a first electrode of the sixth transistor M6 is coupled to the third node N3, and a second electrode of the sixth transistor M6 is coupled to the fourth node N4;

a seventh transistor M7, wherein a control electrode of the seventh transistor M7 is coupled to the scan signal terminal GATE, a first electrode of the seventh transistor M7 is coupled to the fourth node N4, and a second electrode of the seventh transistor M7 is coupled to the fifth node N5;

a eighth transistor M8, wherein a control electrode of the eighth transistor M8 is coupled to the enable signal terminal EM, a first electrode of the eighth transistor M8 is coupled to the gating circuit 120, and a second electrode of the eighth transistor M8 is coupled to the third node N3;

a ninth transistor M9, wherein a control electrode of the ninth transistor M9 is coupled to the enable signal terminal EM, a first electrode of the ninth transistor M9 is coupled to the fourth node N4, and a second electrode of the ninth transistor M9 is coupled to the element to be driven 200;

a tenth transistor M10, wherein a control electrode of the tenth transistor M10 is coupled to the reset signal terminal RESET, a first electrode of the tenth transistor M10 is coupled to the initialization signal terminal VINIT, and a second electrode of the tenth transistor M10 is coupled to the fifth node N5;

a third capacitor Cst, wherein a first terminal of the third capacitor Cst is coupled to the first voltage signal terminal VDD, and a second terminal of the third capacitor Cst is coupled to the fifth node N5.

Continue to refer to FIG. 8, the gating circuit 120 includes:

a first transistor M1, wherein a control electrode of the first transistor M1 is coupled to the scan signal terminal GATE, a first electrode of the first transistor M1 is coupled to the second data signal terminal DATA2, and a second electrode of the first transistor M1 is coupled to the first node N1;

a second transistor M2, wherein a control electrode of the second transistor M2 is coupled to the first node N1, a first electrode of the second transistor M2 is coupled to the second voltage signal terminal V2 (VSS), and a second electrode of the second transistor M2 is coupled to the first electrode of the eighth transistor M8:

a first capacitor C1, wherein a first terminal of the first capacitor C1 is coupled to the initialization signal terminal VINIT, and a second terminal of the first capacitor C1 is coupled to the first node N1;

a third transistor M3, wherein a control electrode of the third transistor M3 is coupled to the reset signal terminal RESET, a first electrode of the third transistor M3 is coupled to the second data signal terminal DATA2, and a second electrode of the third transistor M3 is coupled to the second node N2:

a fourth transistor M4, wherein a control electrode of the fourth transistor M4 is coupled to the second node N2, a first electrode of the fourth transistor M4 is coupled to the third voltage signal terminal VHf, and a second electrode of the fourth transistor M4 is coupled to the first electrode of the eighth transistor M8;

a second capacitor C2, wherein a first terminal of the second capacitor C2 is coupled to the initialization signal terminal VINIT, and a second terminal of the second capacitor C2 is coupled to the second node N2.

Some embodiments of the present disclosure also provide a pixel driving method of the above driving circuit, in which the gating circuit of the pixel driving circuit includes a first gating sub-circuit and a second gating sub-circuit; one frame period includes a reset phase, a scan phase, and a light emitting phase.

The pixel driving method includes:

in the case where the display luminance of the element to be driven 200 is required to be a high gray scale:

during the reset phase T1, the second gating sub-circuit 20 writes a turn-off voltage Vd of the second data signal Data2 from the second data signal terminal DATA2 under the control of the reset signal Reset from the reset signal terminal RESET; the third voltage signal terminal VHf is (electrically) disconnected from the element to be driven 200;

during the scan phase T2, the first gating sub-circuit 10 writes a turn-on voltage Vt of the second data signal Data2 from the second data signal terminal DATA2 under the control of the scan signal Gate from the scan signal terminal GATE; the second voltage signal terminal V2 is (electrically) connected to the element to be driven 200;

during the light emitting phase T3, the first gating sub-circuit 10 transmits the second voltage signal V02 from the second voltage signal terminal V2 to the element to be driven 200, and drives the element to be driven 200 to continuously emit light in cooperation with the current control circuit 110 of the pixel driving circuit 100, under the control of the turn-on voltage Vt of the second data signal Data2;

in the case where the display luminance of the element to be driven 200 is required to be a low gray scale;

during the reset phase T1, the second gating sub-circuit 20 writes the turn-on voltage Vt of the second data signal Data2 from the second data signal terminal DATA2 under the control of the reset signal Reset from the reset signal terminal RESET; the third voltage signal terminal VHf is connected to the element to be driven 200;

during the scan phase T2, the first gating sub-circuit 10 writes the turn-off voltage Vd of the second data signal Data2 from the second data signal terminal DATA2 under the control of the scan signal Gate from the scan signal terminal GATE, the second voltage signal terminal V2 is disconnected from the element to be driven 200.

during the light emitting phase T3, the second gating sub-circuit 20 transmits the third voltage signal Vhf from the third voltage signal terminal VHf to the element to be driven 200, and drives the element to be driven 200 to intermittently emit light in cooperation with the current control circuit 110 of the pixel driving circuit 100, under the control of the turn-on voltage Vt of the second data signal Data2.

For example, by taking the pixel driving circuit shown in FIG. 5 as an example, in the case where the display luminance of the element to be driven 200 is required to be a high gray scale, FIGS. 5 and 6 are referred to for the gating circuit 120.

During the reset phase T1, the reset signal Reset of the reset signal terminal RESET is a low level signal, the third transistor M3 is turned on, and the turn-off voltage Vd (high level signal) of the second data signal Data2 of the second data signal terminal DATA2 is transmitted to the second node N2. The scan signal Gate of the scan signal terminal GATE is a high level signal, the first transistor M1 is turned off, and the turn-off voltage Vd (high level signal) of the second data signal Data2 of the second data signal terminal DATA2 cannot be transmitted to the first node N1.

During the scan phase T2, the reset signal Reset of the reset signal terminal RESET is a high level signal, the third transistor M3 is turned off, and the second node N2 maintains the turn-off voltage Vd (high level signal) under the action of the second capacitor C2. The scan signal Gate of the scan signal terminal GATE is a low level signal, the first transistor M1 is turned on, and the turn-on voltage Vt (low level signal) of the second data signal Data2 of the second data signal terminal DATA2 is transmitted to the first node N1.

During the light emitting phase T3, the reset signal Reset of the reset signal terminal RESET is a high level signal, the third transistor M3 is turned off, the second node N2 maintains the turn-off voltage Vd (high level signal) under the action of the second capacitor C2, the fourth transistor M4 is turned off, and the third voltage signal terminal VHf is disconnected from the element to be driven 200. The scan signal Gate of the scan signal terminal GATE is a high level signal, the first transistor M1 is turned off, the first node N1 maintains the turn-on voltage Vt (low level signal) under the action of the first capacitor C1, the second transistor M2 is turned on, and the second voltage signal terminal V2 is connected to the element to be driven 200. The element to be driven 200 continuously emits light.

In the case where the display luminance of the element to be driven 200 is required to be a low gray scale, FIGS. 5 and 7 are referred to for the gating circuit 120.

During the reset phase T1, the reset signal Reset of the reset signal terminal RESET is a low level signal, the third transistor M3 is turned on, and the turn-on voltage Vt (low level signal) of the second data signal Data2 of the second data signal terminal DATA2 is transmitted to the second node N2. The scan signal Gate of the scan signal terminal GATE is a high level signal, the first transistor M1 is turned off, and the turn-on voltage Vt (low level signal) of the second data signal Data2 of the second data signal terminal DATA2 cannot be transmitted to the first node N1.

During the scan phase T2, the reset signal Reset of the reset signal terminal RESET is a high level signal, the third transistor M3 is turned off, and the second node N2 maintains the turn-on voltage Vt (low level signal) under the action of the second capacitor C2. The scan signal Gate of the scan signal terminal GATE is a low level signal, the first transistor M1 is turned on, and the turn-off voltage Vd (high level signal) of the second data signal Data2 of the second data signal terminal DATA2 is transmitted to the first node N1.

During the light emitting phase T3, the reset signal Reset of the reset signal terminal RESET is a high level signal, the third transistor M3 is turned off, the second node N2 maintains the turn-on voltage Vt (low level signal) under the action of the second capacitor C2, the fourth transistor M4 is turned on, and the third voltage signal terminal VHf is connected to the element to be driven 200. The scan signal Gate of the scan signal terminal GATE is a high level signal, the first transistor M1 is turned off, the first node N1 maintains the turn-off voltage Vd (high level signal) under the action of the first capacitor C1, the second transistor M2 is turned off, and the second voltage signal terminal V2 is disconnected from the element to be driven 200. The element to be driven 200 intermittently emits light. When the third voltage signal terminal VHf is a low level signal, the element to be driven 200 emits light.

Figure 9:
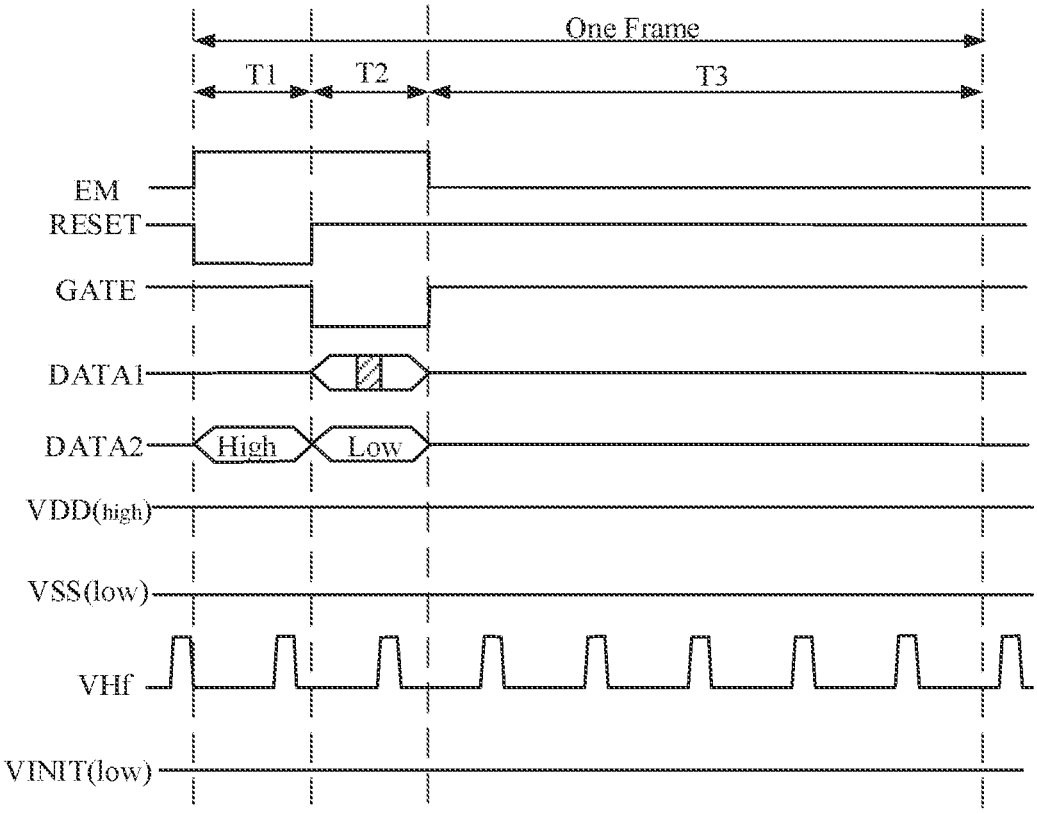
FIG. 9 is a timing diagram when the pixel driving circuit shown in FIG. 8 is displaying a high gray scale.

For example, by taking the pixel driving circuit shown in FIG. 8 as an example, in the case where the display luminance of the element to be driven 200 is required to be a high gray scale, FIGS. 8 and 9 are referred to for the gating circuit 120.

During the reset phase T1, the reset signal Reset of the reset signal terminal RESET is a low level signal, the third transistor M3 is turned on, and the turn-off voltage Vd (high level signal) of the second data signal Data2 of the second data signal terminal DATA2 is transmitted to the second node N2. The scan signal Gate of the scan signal terminal GATE is a high level signal, the first transistor M1 is turned off, and the turn-off voltage Vd (high level signal) of the second data signal Data2 of the second data signal terminal DATA2 cannot be transmitted to the first node N1.

During the scan phase T2, the reset signal Reset of the reset signal terminal RESET is a high level signal, the third transistor M3 is turned off, and the second node N2 maintains the turn-off voltage Vd (high level signal) under the action of the second capacitor C2. The scan signal Gate of the scan signal terminal GATE is a low level signal, the first transistor M1 is turned on, and the turn-on voltage Vt (low level signal) of the second data signal Data2 of the second data signal terminal DATA2 is transmitted to the first node N1.

During the light emitting phase T3, the reset signal Reset of the reset signal terminal RESET is a high level signal, the third transistor M3 is turned off, the second node N2 maintains the turn-off voltage Vd (high level signal) under the action of the second capacitor C2, the fourth transistor M4 is turned off, and the third voltage signal terminal VHf is disconnected from the element to be driven 200. The scan signal Gate of the scan signal terminal GATE is a high level signal, the first transistor M1 is turned off, the first node N1 maintains the turn-on voltage Vt (low level signal) under the action of the first capacitor C1, the second transistor M2 is turned on, and the second voltage signal terminal V2 is connected to the element to be driven 200. The element to be driven 200 continuously emits light.

Figure 10:
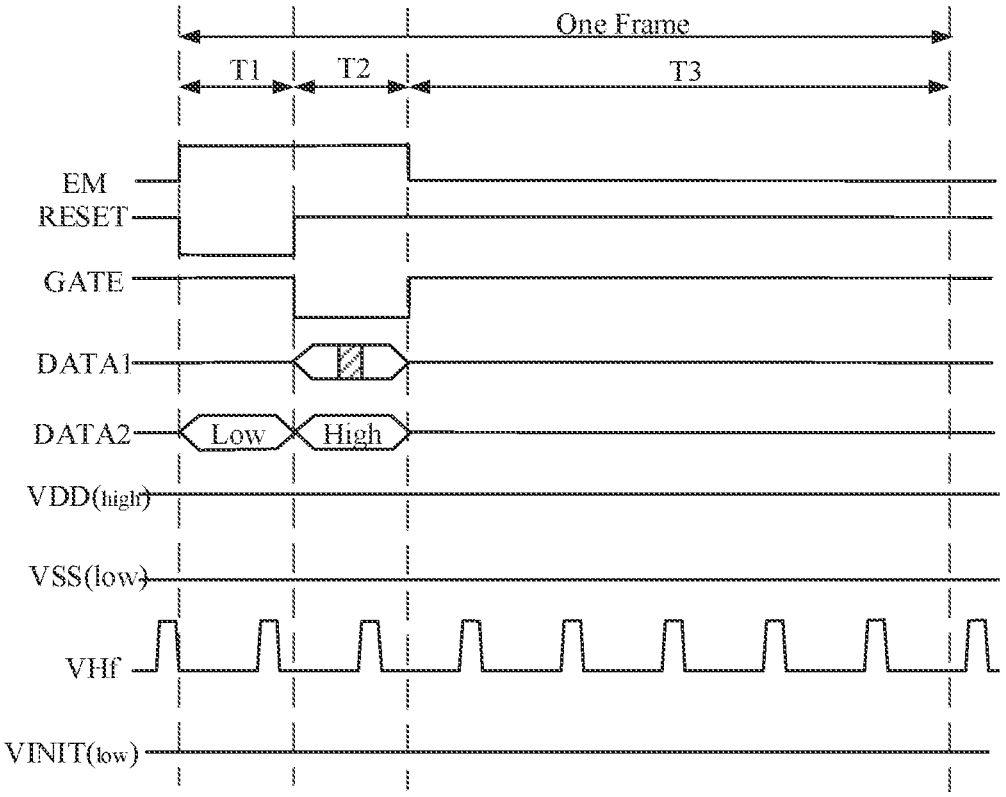
FIG. 10 is a timing diagram when the pixel driving circuit shown in FIG. 8 is displaying a low gray scale.

In the case where the display luminance of the element to be driven 200 is required to be a low gray scale, FIGS. 8 and 10 are referred to for the gating circuit 120.

During the reset phase T1, the reset signal Reset of the reset signal terminal RESET is a low level signal, the third transistor M3 is turned on, and the turn-on voltage Vt (low level signal) of the second data signal Data2 of the second data signal terminal DATA2 is transmitted to the second node N2. The scan signal Gate of the scan signal terminal GATE is a high level signal, the first transistor M1 is turned off, and the turn-on voltage Vt (low level signal) of the second data signal Data2 of the second data signal terminal DATA2 cannot be transmitted to the first node N1.

During the scan phase T2, the reset signal Reset of the reset signal terminal RESET is a high level signal, the third transistor M3 is turned off, and the second node N2 maintains the turn-on voltage Vt (low level signal) under the action of the second capacitor C2. The scan signal Gate of the scan signal terminal GATE is a low level signal, the first transistor M1 is turned on, and the turn-off voltage Vd (high level signal) of the second data signal Data2 of the second data signal terminal DATA2 is transmitted to the first node N1.

During the light emitting phase T3, the reset signal Reset of the reset signal terminal RESET is a high level signal, the third transistor M3 is turned off, the second node N2 maintains the turn-on voltage Vt (low level signal) under the action of the second capacitor C2, the fourth transistor M4 is turned on, and the third voltage signal terminal VHf is connected to the element to be driven 200. The scan signal Gate of the scan signal terminal GATE is a high level signal, the first transistor M1 is turned off the first node N1 maintains the turn-off voltage Vd (high level signal) under the action of the first capacitor C1, the second transistor M2 is turned off, and the second voltage signal terminal V2 is disconnected from the element to be driven 200. The element to be driven 200 intermittently emits light. When the third voltage signal terminal VHf is a high level signal, the element to be driven 200 emits light.

With the above-mentioned pixel driving method, when the element to be driven 200 is required to display a high gray scale, the second voltage signal V02 may be input to the element to be driven 200 by the gating circuit 120, so that the element to be driven 200 continuously emits light in one frame, and the magnitude of the current flowing through the element to be driven 200 is controlled by the first data signal Data1 from the first data signal terminal DATA1, thereby controlling the element to be driven 200 to display different high gray scales.

When the display luminance of the element to be driven 200 is required to be a low gray scale, the third voltage signal Vhf may be input to the element to be driven 200 by the gating circuit 120, so that the element to be driven 200 intermittently emits light in one frame, and thus, the light emitting duration of the element to be driven 200 in one frame is shortened; further, without reducing the light emitting intensity of the element to be driven 200 (without reducing the current flowing through the element to be driven 200 when the element to be driven 200 emits light), the luminance (gray scale) of the element to be driven 200 perceived by human eyes is reduced, so that the element to be driven 200 displays a low gray scale at a higher current. Thus, the current magnitude of the element to be driven 200 when displaying a low gray scale may be increased, so that the current transmitted to the element to be driven 200 is larger, and the element to be driven 200 may display a high gray scale and a low gray scale at high current density, thereby enabling the element to be driven 200 to realize full gray scale display.

In some embodiments, the pixel driving method further includes:

during the reset phase T1, the reset signal Reset of the reset signal terminal RESET is a low level signal, the tenth transistor M10 is turned on, the initialization signal Vinit (low level signal) of the initialization signal terminal VINIT is transmitted to the fifth node N2, and the first data signal Data1 of the previous frame stored at the fifth node is cleared; the third capacitor Cst stores the voltage at the fifth node N5;

during the scan phase T2, the scan signal Gate from the scan signal terminal GATE is a low level signal, the fifth transistor M5 and the seventh transistor M7 are turned on, and the first data signal Data1 of the first data signal terminal DATA1 is transmitted to the third node N3; the sixth transistor M6 is turned on under the control of the voltage (low level signal) at the fifth node N5; the fourth node N4 is connected to the fifth node N5 through the seventh transistor M7; at this time, there is a difference between the voltage at the fifth node N5 and the first data signal Data1 transmitted to the third node N3, and the difference is the threshold voltage of the sixth transistor M6;

during the light emitting phase T3, the enable signal Em from the enable signal terminal EM is a low level signal, the eighth transistor M8 and the ninth transistor M9 are turned on, the sixth transistor M6 is turned on under the control of the voltage at the fifth node N5, and the control sub-circuit 70 transmits a driving current signal to the element to be driven 200.

Some embodiments of the present disclosure further provide a display panel 11X), which includes the element to be driven 200 and the pixel driving circuit 100 according to any one of the above embodiments. The display panel 1100 provided by the present disclosure adopts the above pixel driving circuit 100, and in the case where the element to be driven 200 is a Micro LED, according to the characteristic that the Micro LED has high light emitting efficiency at high current density and low light emitting efficiency at low current density, by reducing the light emitting duration of the Micro LED when displaying a low gray scale and increasing the current density of the Micro LED flowing through the element to be driven 200 when displaying a low gray scale, the Micro LED is always at high current density, the light emitting efficiency is higher, thus the power consumption is reduced, and the cost is saved.

In some embodiments, the display panel 1200 further includes a substrate, and the pixel driving circuit 100 is disposed on the substrate which is a glass substrate.

In some embodiments, the display panel is a Micro LED display panel, and each of the plurality of sub-pixels 1101 included in the display panel corresponds to at least one Micro LED.

The particular features, structures, materials, or characteristics may be combined in any suitable manner in any one or more embodiments or examples in the description.

The above description is only for the specific embodiments of the present disclosure, but the scope of the present disclosure is not limited thereto, and any changes or substitutions, which may be easily conceived by one of ordinary skill in the art within the technical scope of the present disclosure, should be covered within the scope of the present disclosure. Therefore, the protection scope of the present disclosure shall be subject to the protection scope of the claims.

What is claimed is:

1. A pixel driving circuit, comprising:

a current control circuit coupled to a scan signal terminal, a first data signal terminal, a first voltage signal terminal, an enable signal terminal, and an element to be driven; the current control circuit being configured to transmit a driving current signal to the element to be driven, according to a first data signal from the first data signal terminal, under the control of a scan signal from the scan signal terminal and an enable signal from the enable signal terminal;

a gating circuit coupled to the scan signal terminal, a reset signal terminal, a second data signal terminal, a second voltage signal terminal, and a third voltage signal terminal; the gating circuit being configured to transmit a second voltage signal from the second voltage signal terminal to the element to be driven, such that the element to be driven continuously emits light, or transmit a third voltage signal from the third voltage signal terminal to the element to be driven, such that the element to be driven intermittently emits light, under the control of a scan signal from the scan signal terminal, a reset signal from the reset signal terminal, and a second data signal from the second data signal terminal, wherein the gating circuit comprises:

a first gating sub-circuit coupled to the scan signal terminal, the second data signal terminal, and the second voltage signal terminal; the first gating sub-circuit being configured to transmit the second voltage signal from the second voltage terminal to the element to be driven, under the control of the scan signal from the scan signal terminal and the second data signal from the second data signal terminal, such that the element to be driven continuously emits light; and a second gating sub-circuit coupled to the reset signal terminal, the second data signal terminal, and the third voltage signal terminal; the second gating sub-circuit being configured to transmit the third voltage signal from the third voltage terminal to the element to be driven, under the control of the reset signal from the reset signal terminal and the second data signal from the second data signal terminal, such that the element to be driven intermittently emits light.

2. The pixel driving circuit according to claim 1, wherein the first gating sub-circuit comprises:

a first data writing unit coupled to the scan signal terminal, the second data signal terminal, and a first node; the first data writing unit being configured to transmit the second data signal from the second data signal terminal to the first node, under the control of the scan signal from the scan signal terminal; and a first control unit coupled to the first node and the second voltage signal terminal; the first control unit being configured to transmit the second voltage signal from the second voltage terminal to the element to be driven, under the control of a voltage at the first node.

3. The pixel driving circuit according to claim 2, wherein the first gating sub-circuit further comprises:

a first energy storage unit coupled to an initialization signal terminal and the first node; the first energy storage unit being configured to store and maintain the voltage at the first node.

4. The pixel driving circuit according to claim 3, wherein the first energy storage unit comprises:

a first capacitor having a first terminal coupled to the initialization signal terminal and a second terminal coupled to the first node.

5. The pixel driving circuit according to claim 2, wherein the first data writing unit comprises:

a first transistor having a control electrode coupled to the scan signal terminal, a first electrode coupled to the second data signal terminal, and a second electrode coupled to the first node.

6. The pixel driving circuit according to claim 2, wherein the first control unit comprises:

a second transistor having a control electrode coupled to the first node, a first electrode coupled to the second voltage signal terminal, and a second electrode coupled to the element to be driven or the current control circuit.

7. The pixel driving circuit according to claim 1, wherein the second gating sub-circuit comprises: a second data writing unit coupled to the reset signal terminal, the second data signal terminal, and a second node; the second data writing unit being configured to transmit the second data signal from the second data signal terminal to the second node, under the control of the reset signal from the reset signal terminal; a second control unit coupled to the second node and the third voltage signal terminal; the second control unit being configured to transmit the third voltage signal from the third voltage terminal to the element to be driven, under the control of a voltage at the second node.

8. The pixel driving circuit according to claim 7, wherein the second gating sub-circuit further comprises:

a second energy storage unit coupled to an initialization signal terminal and the second node; the second energy storage unit being configured to store and maintain the voltage at the second node.

9. The pixel driving circuit according to claim 8, wherein the second energy storage unit comprises:

a second capacitor having a first terminal coupled to the initialization signal terminal and a second terminal coupled to the second node.

10. The pixel driving circuit according to claim 7, wherein the second data writing unit comprises:

a third transistor having a control electrode coupled to the reset signal terminal, a first electrode coupled to the second data signal terminal, and a second electrode coupled to the second node;

the second control unit comprises:

a fourth transistor having a control electrode coupled to the second node, a first electrode coupled to the third voltage signal terminal, and a second electrode coupled to the element to be driven or the current control circuit.

11. The pixel driving circuit according to claim 1, wherein the second voltage signal terminal is a signal terminal for transmitting a direct current voltage signal; and the third voltage signal terminal is a signal terminal for transmitting a pulse voltage signal.

12. The pixel driving circuit according to claim 1, wherein the current control circuit is coupled to a first electrode of the element to be driven, the gating circuit is coupled to a second electrode of the element to be driven, and a voltage signal transmitted by the second voltage signal terminal is different from a voltage signal transmitted by the first voltage signal terminal; or, the current control circuit is coupled to a first electrode of the element to be driven, a second electrode of the element to be driven is coupled to a direct current voltage signal terminal, the gating circuit is coupled to the current control circuit, and a voltage signal transmitted by the second voltage signal terminal is the same as a voltage signal transmitted by the first voltage signal terminal.

13. The pixel driving circuit according to claim 1, wherein the current control circuit comprises:

a data writing sub-circuit coupled to the scan signal terminal, the first data signal terminal, and a third node; the data writing sub-circuit being configured to transmit the first data signal from the first data signal terminal to the third node, under the control of the scan signal from the scan signal terminal;

a driving sub-circuit coupled to the third node, a fourth node, and a fifth node; the driving sub-circuit being configured to be turned on under the control of a voltage at the fifth node;

a compensation sub-circuit coupled to the scan signal terminal, the fourth node, and the fifth node; the compensation sub-circuit being configured to compensate the voltage at the fifth node, under the control of the scan signal from the scan signal terminal, so that the voltage at the fifth node is related to a threshold voltage of the driving sub-circuit;

an energy storage sub-circuit coupled to the fifth node and the first voltage signal terminal; the energy storage sub-circuit being configured to store and maintain the voltage at the fifth node;

a control sub-circuit coupled to the enable signal terminal, the third node, the fourth node, and the element to be driven, the control sub-circuit being further coupled to the first voltage signal terminal or the gating circuit; the control sub-circuit being configured to transmit a driving current signal to the element to be driven in cooperation with the driving sub-circuit, under the control of the enable signal from the enable signal terminal; and a reset sub-circuit coupled to the reset signal terminal, an initialization signal terminal, and the fifth node; the reset sub-circuit being configured to transmit an initialization voltage signal from the initialization signal terminal to the fifth node, under the control of the reset signal from the reset signal terminal.

14. The pixel driving circuit according to claim 13, wherein the data writing sub-circuit comprises:

a fifth transistor having a control electrode coupled to the scan signal terminal, a first electrode coupled to the first data signal terminal, and a second electrode coupled to the third node;

the driving sub-circuit comprises:

a sixth transistor having a control electrode coupled to the fifth node, a first electrode coupled to the third node, and a second electrode coupled to the fourth node;

the compensation sub-circuit comprises:

a seventh transistor having a control electrode coupled to the scan signal terminal, a first electrode coupled to the fourth node, and a second electrode coupled to the fifth node;

the energy storage sub-circuit comprises:

a third capacitor having a first terminal coupled to the first voltage signal terminal and a second terminal coupled to the fifth node;

the control sub-circuit comprises:

an eighth transistor having a control electrode coupled to the enable signal terminal, a first electrode coupled to the first voltage signal terminal or the gating circuit, and a second electrode coupled to the third node;

a ninth transistor having a control electrode coupled to the enable signal terminal, a first electrode coupled to the fourth node, and a second electrode coupled to the element to be driven;

the reset sub-circuit comprises:

a tenth transistor having a control electrode coupled to the reset signal terminal, a first electrode coupled to the initialization signal terminal, and a second electrode coupled to the fifth node.

15. The pixel driving circuit according to claim 1, wherein the current control circuit comprises:

a fifth transistor having a control electrode coupled to the scan signal terminal, a first electrode coupled to the first data signal terminal, and a second electrode coupled to a third node;

a sixth transistor having a control electrode coupled to a fifth node, a first electrode coupled to the third node, and a second electrode coupled to a fourth node;

a seventh transistor having a control electrode coupled to the scan signal terminal, a first electrode coupled to the fourth node, and a second electrode coupled to the fifth node;

an eighth transistor having a control electrode coupled to the enable signal terminal, a first electrode coupled to the first voltage signal terminal, and a second electrode coupled to the third node;

a ninth transistor having a control electrode coupled to the enable signal terminal, a first electrode coupled to the fourth node, and a second electrode coupled to a first electrode of the element to be driven;

a tenth transistor having a control electrode coupled to the reset signal terminal, a first electrode coupled to an initialization signal terminal, and a second electrode coupled to the fifth node;

a third capacitor having a first terminal coupled to the first voltage signal terminal and a second terminal coupled to the fifth node;

the gating circuit comprises:

a first transistor having a control electrode coupled to the scan signal terminal, a first electrode coupled to the second data signal terminal, and a second electrode coupled to the first node;

a second transistor having a control electrode coupled to the first node, a first electrode coupled to the second voltage signal terminal, and a second electrode coupled to a second electrode of the element to be driven;

a first capacitor having a first terminal coupled to the initialization signal terminal and a second terminal coupled to the first node;

a third transistor having a control electrode coupled to the reset signal terminal, a first electrode coupled to the second data signal terminal, and a second electrode coupled to the second node;

a fourth transistor having a control electrode coupled to the second node, a first electrode coupled to the third voltage signal terminal, and a second electrode coupled to the second electrode of the element to be driven; and a second capacitor having a first terminal coupled to the initialization signal terminal and a second terminal coupled to the second node.

16. The pixel driving circuit according to claim 1, wherein the current control circuit comprises;

a fifth transistor having a control electrode coupled to the scan signal terminal, a first electrode coupled to the first data signal terminal, and a second electrode coupled to a third node;

a sixth transistor having a control electrode coupled to a fifth node, a first electrode coupled to the third node, and a second electrode coupled to a fourth node;

a seventh transistor having a control electrode coupled to the scan signal terminal, a first electrode coupled to the fourth node, and a second electrode coupled to the fifth node;

an eighth transistor having a control electrode coupled to the enable signal terminal, a first electrode coupled to the gating circuit, and a second electrode coupled to the third node;

a ninth transistor having a control electrode coupled to the enable signal terminal, a first electrode coupled to the fourth node, and a second electrode coupled to a first electrode of the element to be driven;

a tenth transistor having a control electrode coupled to the reset signal terminal, a first electrode coupled to an initialization signal terminal, and a second electrode coupled to the fifth node;

a third capacitor having a first terminal coupled to the first voltage signal terminal and a second terminal coupled to the fifth node;

the gating circuit comprises:

a first transistor having a control electrode coupled to the scan signal terminal, a first electrode coupled to the second data signal terminal, and a second electrode coupled to the first node;

a second transistor having a control electrode coupled to the first node, a first electrode coupled to the second voltage signal terminal, and a second electrode coupled to the first electrode of the eighth transistor;

a first capacitor having a first terminal coupled to the initialization signal terminal and a second terminal coupled to the first node;

a third transistor having a control electrode coupled to the reset signal terminal, a first electrode coupled to the second data signal terminal, and a second electrode coupled to the second node;

a fourth transistor having a control electrode coupled to the second node, a first electrode coupled to the third voltage signal terminal, and a second electrode coupled to the first electrode of the eighth transistor;

a second capacitor having a first terminal coupled to the initialization signal terminal and a second terminal coupled to the second node.

17. A pixel driving method applied to the pixel driving circuit according to claim 1, wherein the gating circuit of the pixel driving circuit comprises a first gating sub-circuit and a second gating sub-circuit; one frame period comprises a reset phase, a scan phase, and a light emitting phase;

the pixel driving method comprises:

in the case where the display luminance is required to be a high gray scale, during the reset phase, the second gating sub-circuit writes a turn-off voltage of the second data signal from the second data signal terminal, under the control of the reset signal from the reset signal terminal;

during the scan phase, the first gating sub-circuit writes a turn-on voltage of a second data signal from the second data signal terminal, under the control of the scan signal from the scan signal terminal;

during the light emitting phase, the first gating sub-circuit transmits the second voltage signal from the second voltage signal terminal to the element to be driven, and drives the element to be driven to continuously emit light in cooperation with the current control circuit of the pixel driving circuit, under the control of the turn-on voltage of the second data signal;

in the case where the display luminance is required to be a low gray scale, during the reset phase, the second gating sub-circuit writes the turn-on voltage of the second data signal from the second data signal terminal, under the control of the reset signal from the reset signal terminal;

during the scan phase, the first gating sub-circuit writes the turn-off voltage of a second data signal from the second data signal terminal, under the control of the scan signal from the scan signal terminal;

during the light emitting phase, the second gating sub-circuit transmits the third voltage signal from the third voltage signal terminal to the element to be driven, and drives the element to be driven to intermittently emit light in cooperation with the current control circuit of the pixel driving circuit, under the control of the turn-on voltage of the second data signal.

18. A display panel, comprising:

the pixel driving circuit according to claim 1; and an element to be driven, which is coupled to the pixel driving circuit.

19. A display device, comprising the display panel according to claim 18.

* * * * *